US007610136B2

(12) United States Patent
Okamura et al.

(10) Patent No.: US 7,610,136 B2
(45) Date of Patent: Oct. 27, 2009

(54) CONTROLLER FOR WORK IMPLEMENT OF CONSTRUCTION MACHINERY, METHOD FOR CONTROLLING CONSTRUCTION MACHINERY, AND PROGRAM ALLOWING COMPUTER TO EXECUTE THIS METHOD

(75) Inventors: Kenji Okamura, Hiratsuka (JP); Matsuo Nose, Hiratsuka (JP); Yoichiro Kimura, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 880 days.

(21) Appl. No.: 11/055,466

(22) Filed: Feb. 9, 2005

(65) Prior Publication Data

US 2005/0177292 A1 Aug. 11, 2005

(30) Foreign Application Priority Data

Feb. 10, 2004 (JP) ..... 2004-034173
Feb. 1, 2005 (JP) ..... 2005-025681

(51) Int. Cl.
*G01D 18/00* (2006.01)
*G01P 21/00* (2006.01)
*G06F 19/00* (2006.01)
*G06F 7/00* (2006.01)

(52) U.S. Cl. ..... 701/50; 700/213; 37/444; 702/85

(58) Field of Classification Search ..... 701/50; 60/469, 426; 91/461; 172/8; 700/61, 213, 700/254; 37/411, 444, 434, 413, 466; 702/56, 702/85; 187/292; 414/493, 815; 901/48
See application file for complete search history.

(56) References Cited

U.S. PATENT DOCUMENTS 5,701,793 A 12/1997 Gardner et al.

(Continued)

FOREIGN PATENT DOCUMENTS

CN 1141680 A 1/1997

(Continued)

OTHER PUBLICATIONS

Chinese Office Action (and English translation thereof) dated Jan. 4, 2008, issued in a counterpart Chinese Application.

*Primary Examiner*—Thomas G Black
*Assistant Examiner*—Christine M Behncke
(74) *Attorney, Agent, or Firm*—Frishauf, Holtz, Goodman & Chick, P.C.

(57) ABSTRACT

A controller for a work implement (10, 30) of a construction machine (1, 3) comprising: a manipulating signal input unit (21) including a target value computing section (25) for generating an operation target value (V1) for the work implement (10, 30) based on a manipulating signal (F, Fa) inputted from a manipulating unit (2) for manipulating the work implement (10, 30), a target value correcting unit (22, 37) for correcting the generated operation target value (V1), and an instruction signal output unit (23) for outputting an instruction signal to an actuator (19, 34) for driving the work implement (10, 30) according to the corrected target value (V2); wherein the target value correcting unit (22, 37) comprises a vibration suppressing unit (29) for correcting the operation target value (V1) to another target value to suppress vibrations of the construction machine (1, 3) according to the vibration characteristics, which vary according to a posture of and/or a load to the work implement (10, 30).

9 Claims, 16 Drawing Sheets

U.S. PATENT DOCUMENTS

| | | | | |
|---|---|---|---|---|
| 5,832,730 | A * | 11/1998 | Mizui | 60/469 |
| 6,047,228 | A * | 4/2000 | Stone et al. | 701/50 |
| 6,553,278 | B2 * | 4/2003 | Handroos et al. | 700/213 |
| 2003/0018400 | A1 * | 1/2003 | Tuttle et al. | 700/29 |
| 2003/0230010 | A1 | 12/2003 | Sharkness et al. | |
| 2004/0060205 | A1 * | 4/2004 | Yoshino | 37/348 |

FOREIGN PATENT DOCUMENTS

| | | | |
|---|---|---|---|
| EP | 1 174 384 | A1 | 1/2002 |
| JP | 02-48602 | U | 4/1990 |
| JP | 04-181003 | A | 6/1992 |
| JP | 04-353130 | A | 12/1992 |
| JP | 06-222817 | A | 8/1994 |
| JP | 09-324443 | A | 12/1997 |

* cited by examiner

CONTROLLER FOR WORK IMPLEMENT OF CONSTRUCTION MACHINERY, METHOD FOR CONTROLLING CONSTRUCTION MACHINERY, AND PROGRAM ALLOWING COMPUTER TO EXECUTE THIS METHOD

BACKGROUND OF THE INVENTION

1. Field of the Invention

The present invention relates to a controller for work implement of construction machinery, a method for controlling a construction machinery, and a program allowing a computer to execute this method.

2. Description of Related Art

For instance, a construction machine such as a hydraulic shovel carries out various types of works by driving a work implement consisting of an arm or a boom, there is the problem that vibrations occur in the work implement when an operation of the work implement is stopped or the work implement is started from the rest state.

In a case where the work implement is driven by an actuator including a hydraulic cylinder, this phenomenon occurs when supply of a hydraulic oil to the actuator is transitionally stopped or supply of a hydraulic oil is started suddenly all at once, and also because an inertial force of the operation machine in the rest state or in the operating state can not smoothly be absorbed.

When vibrations occur in a work implement with large inertia such as a boom or an arm, the entire hydraulic shovel largely swing, so that also an operator operating an operation lever thereof swing with the operability spoiled.

Further, when the work implement is swinging, it is impossible to shift an operation of the work implement to the next one, so that the operation is delayed with the work efficiency lowered. It is possible to suppress vibrations of the work implement in the rest state or upon start of the operations thereof by making the work implement run slowly, but in this state, the performance of the hydraulic shovel is not fully achieved, and the work efficiency is low also in this state.

To overcome the problems as described above, there have been proposed various types of controllers and control methods for suppressing vibration of a work implement (Refer to, for instance, cited reference 1: Japanese Utility Model Publication No. HEI 248602, cited reference 2: Japanese Patent Laid-Open Publication No. HEI 4-181003, cited reference 3: Japanese Patent Laid-Open Publication No. HEI 4-353130, cited reference 4: Japanese Patent Laid-Open Publication No. HEI 9-324443, cited reference 5: Japanese Patent Laid-Open Publication No. HEI 6-222817).

The cited reference 1 discloses that by providing a throttle in a pilot passage, which operates the flow controlling valve, the pilot pressure of a pilot valve, which operates in the interlocking relationship with the operation lever, is throttled, and thereby the flow controlling valve is slowly operated so that the vibration is suppressed.

The technology disclosed in the cited reference 2 is based on the modulation system in which, when an operation of a work implement is stopped by operating a lever thereof, based on the position and speed of the hydraulic cylinder when the deceleration operation starts, a flow rate of a hydraulic oil to the hydraulic cylinder is restricted by dulling an instruction signal to a flow rate control valve, and vibrations are suppressed by selecting the soft mode in which an instruction signal is dulled.

In the technology disclosed in the cited reference 3, in addition to a first flow rate control valve operating according to an instruction signal from a operation lever when feeding a hydraulic oil to a hydraulic cylinder, there is provided a second flow rate control valve which is auxiliary and operates according to a signal from a controller, and when an operation of the work implement is stopped by supplying a hydraulic oil from the first flow rate control valve, also a hydraulic oil is fed at a prespecified rate from the second flow rate control valve to suppress generation of vibrations.

With the technology disclosed in the cited reference 4, when an operation of a work implement is stopped by operating a lever of the work implement, a flow rate of a hydraulic oil fed to the hydraulic cylinder is gradually reduced from that at a starting point of the operation of the operation lever to suppress vibrations of the work implement.

The technology disclosed in the cited reference 5 relates to a welding robot not having any direct connection with construction machinery. Namely, when weaving welding is performed with a welding robot, the phenomenon occurs that the actual amplitude is different from that instructed for weaving due to the resonance characteristics as well as the phase characteristics of the robot, and to solve this problem, reverse transfer functions are applied as filters for compensating the characteristics respectively, and by outputting an instruction for an amplitude through the filters to a driving section to realize weaving welding with the instructed amplitude. It is conceivable to apply this technology for suppressing vibrations in a construction machine.

In the technology disclosed in the cited reference 1, however, even if it is tried to stop operations of a work implement, for instance, by returning a lever of the work implement to the neutral position, the pilot pressure is throttled due to throttling, so that the flow rate control valve operates only slowly.

Because of this feature, the speed change in the work implement is rather slow, so that vibrations are suppressed to some extent, but a long period of time is required until the operation of the work implement is completely stopped, which disadvantageously causes a delay in stopping the machine's operation.

With the technology disclosed in the cited reference 2, a stroke position and the speed are detected immediately after a lever of a work implement is operated and at the same time a stroke position required for smoothly and quickly stopping the machine's operation without causing vibrations is computed according to a result of detection above, and a flow rate of the hydraulic oil is controlled for the stroke position for stopping operations of the work implement, so that a delay in stopping the machine's operation occurs also in this case.

In the technology disclosed in the cited reference 3, an auxiliary electromagnetic valve is required, and the configuration is complicated. In addition, it is necessary to take into considerations a speed of and a load to the work implement for deciding a flow rate from the second flow rate control valve, and therefore it is necessary to previously prepare a plurality of flow rate decision patterns, and also the processing for pattern selection is disadvantageously complicated.

Further in the cited reference 3, only vibrations generated at a point of time when the hydraulic cylinder is topped can be suppressed, and those generated when an operation of the work implement is started can not be suppressed.

With the technology disclosed in the cited reference 4, a flow rate of a hydraulic oil is gradually reduced by dulling a lever operation signal from a lever of a work implement, the flow control valve operate rather slowly like in the case described above.

Therefore, the operation of the work implement is stopped at a point of time in a certain period of time when the machine's lever is operation when a flow rate of the hydraulic oil comes down to zero, which also leads to a result of a delay in stopping operations of the work implement.

With the cited reference 5 disclosing the technology for weaving welding with the welding robot, an instruction signal for an amplitude inputted into the controller is limited to that having a sinusoidal wave, and therefore in construction machines in which a waveform of an input instruction signal substantially varies according to a way of operation of a lever of each work implement, when the technology is applied as it is, it is difficult to completely suppress vibrations.

SUMMARY OF THE INVENTION

A main object of the present invention is to provide a controller for a work implement, a method for controlling the work implement, and a program for making computer execute this method, which enabling more smooth and quick operations of the work implement by securing suppression of vibrations when an operation of the work implement is started or stopped and also by eliminating a delay time in starting or stopping the operation and also allowing for simplification in configuration thereof and processing thereby.

The controller according to the present invention for a work implement of a construction machine includes a manipulating signal input unit having a target value computing section for generating an operation target value for the work implement based on a manipulating signal inputted from a manipulating unit for manipulating the work implement; a target value correcting unit for correcting the generated operation target value; and an instruction signal output unit for outputting an instruction signal to an actuator for driving the work implement according to the corrected target value, and is characterized in that the target value correcting unit includes a vibration suppressing unit for correcting the operation target value to another target value to suppress vibrations of the construction machine according to the vibration characteristics, which vary according to a posture of and/or a load to the work implement.

The target value computing section described above is not always required to convert a manipulating signal by way of amplification, modulation or the like, and the concept of the target value computing section as used herein also includes a function directly processing a manipulating signal as an operation target value and not or little converting the manipulating signal.

The controller according to the present invention for a work implement of a construction machine includes a manipulating signal input unit having a target value computing section for generating an operation target value for the work implement based on a manipulating signal inputted from a manipulating unit for manipulating the work implement; a target value correcting unit for correcting the generated operation target value; and an instruction signal output unit for outputting an instruction signal to an actuator for driving the work implement according to the corrected target value, and is characterized in that the target value correcting unit includes a vibration suppressing unit for correcting the operation target value to another target value to suppress vibrations of the construction machine according to the vibration characteristics varying according to a posture of and/or a load to the construction machine.

In the controller according to the present invention, the target value correcting unit preferably corrects the operation target value, when an increase in change rate of an operation target value is detected, to a larger target value, and when a decrease in a change rate of an operation target value is detected, to a smaller target value.

In the controller according to the present invention, the target value correcting unit includes a vibration characteristic determining unit for determining vibration characteristics of the construction machine or the work implement according to a characteristic frequency and a damping coefficient corresponding to a posture of and a load to the construction machine or the work implement, and the vibration suppressing unit preferably corrects the operation target value according to the characteristic frequency as well as to the damping coefficient.

In the controller according to the present invention, the manipulating unit is a lever for changing a manipulating signal when inclined from the neutral position, and the target value correcting unit preferably corrects the operation target value to a larger value by being triggered with the moment when movement of the lever toward the neutral position thereof is stopped, and also corrects the operation target value to a smaller value by being triggered with the moment when the lever is moved toward the neutral position thereof.

The term of "neutral position" as used herein indicates a lever position at which the manipulating signal outputted from the lever correspond to the point at which the work implement speed is zero, and the same is true also in descriptions of the following inventions.

In the controller according to the present invention, the manipulating unit is a lever for changing a manipulating signal when inclined from the neutral position, and the target value correcting unit preferably corrects the operation target value to a larger value by being triggered with the moment when the operation machine lever is moved away from the neutral position thereof, or when movement of the lever toward the neutral position is stopped, and also corrects the operation target value to a smaller value by being triggered with the moment when movement of the lever away from the neutral position thereof is stopped, or when the lever is moved toward the neutral position thereof.

The control method according to the present invention is based on development of the controller, and the method for controlling a work implement of a construction machine includes generating an operation target value for the work implement based on a manipulating signal input from a manipulating unit for manipulating a work implement; estimating vibration characteristics of the construction machine, based on a characteristic frequency and a damping coefficient corresponding to a posture of and/or a load to the work implement; and correcting the operation target value to another target value that has inverse vibration characteristics to the estimated vibration characteristics based on the characteristic frequency and the damping coefficient to thereby suppress generation of vibrations of the construction machine.

The computer-executable program according to the present invention allows a controller for a construction machine to execute aforesaid method for controlling work implement of construction machinery.

DETAILED DESCRIPTION OF PREFERRED EMBODIMENT(S)

An embodiment of the present invention is described below with reference to the related drawings.

1. First Embodiment (1) General Configuration

Figure 1:
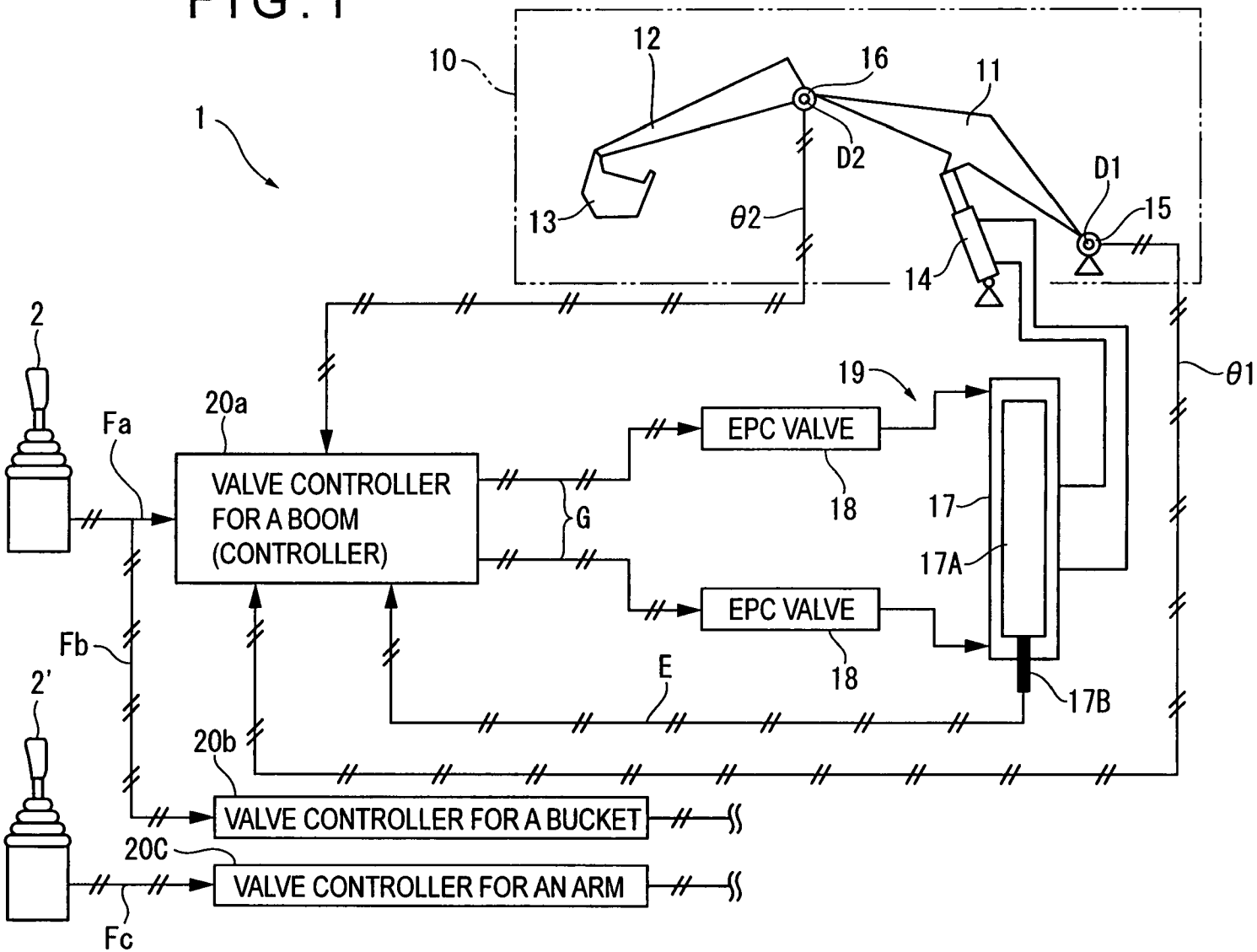
FIG. 1 is a schematic view showing a construction machine with a work implement and a controller each according to a first embodiment of the present invention mounted thereon.
Figure 2:
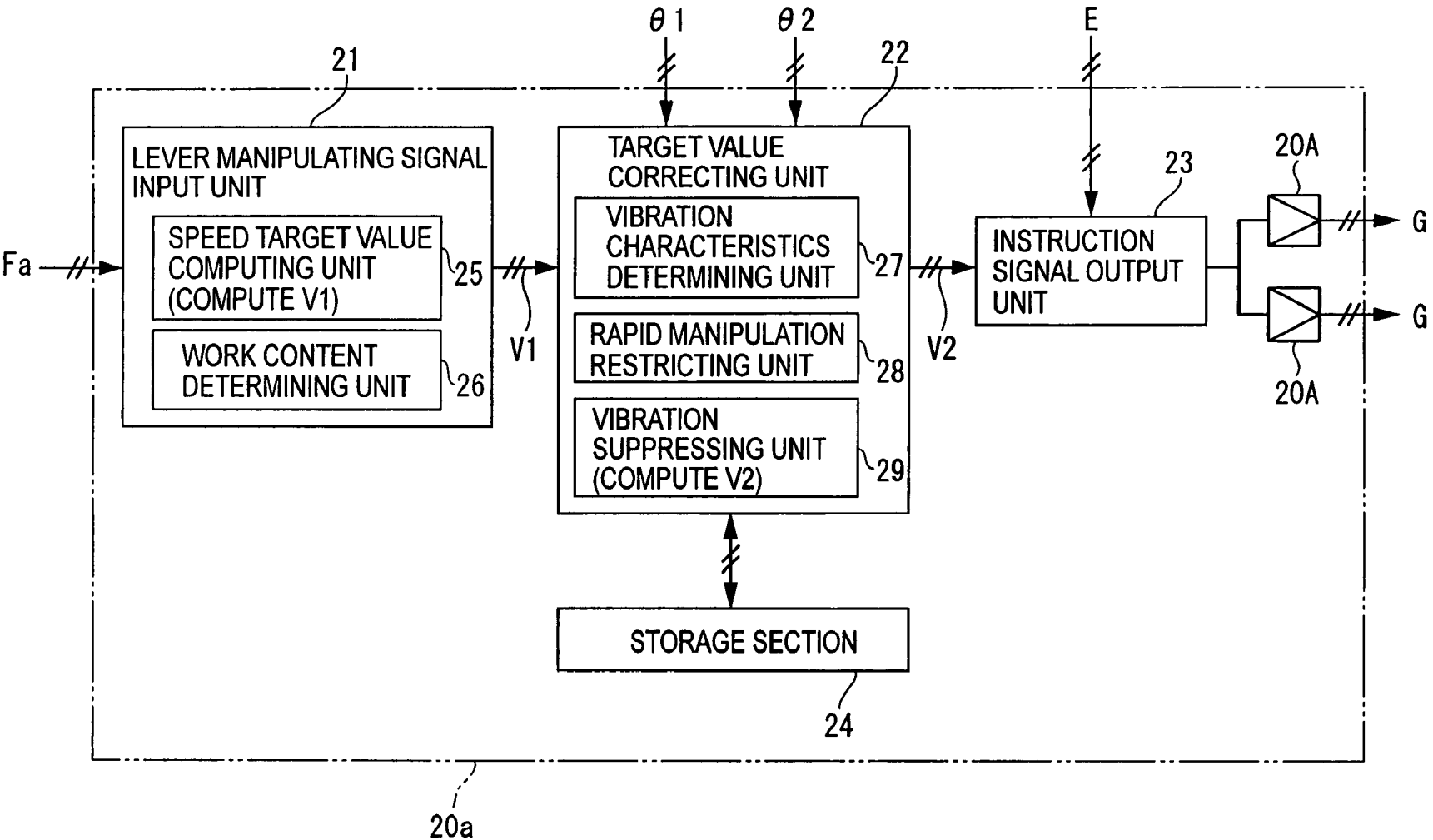
FIG. 2 is a block diagram showing a controller.

FIG. 1 is a schematic view showing a hydraulic shovel (construction machine) 1 with a work implement and a controller for the same according to one embodiment of the present invention mounted thereon. FIG. 2 is a block diagram showing the controller.

In FIG. 1, the hydraulic shovel 1 comprises a boom 11 manipulated by a lever 2, and an arm 12 manipulated by a lever 2', and a bucket 13 is attached to a tip of the arm 12.

The boom 11 is rotated around a supporting point D1 by a hydraulic cylinder 14.

The arm 12 is rotated around a supporting point D2 by a hydraulic cylinder on the boom 11. The bucket 13 is rotated by a hydraulic cylinder on the arm 12 when the lever 2 is manipulated in the other direction. A work implement 10 according to the present invention is formed with the boom 11, arm 12, and bucket 13.

In this embodiment, details of the present invention are described with reference to the boom 11 as the representative, and hydraulic cylinders for the arm 12 and bucket 13 are not shown.

In addition to the bucket 13, any attachment such as a grapple and a hand may be used.

Angle detectors 15, 16 such as rotary encoder or a potentiometer are provided at the supporting point D1 for the boom 11 and at the supporting point D2 for the arm 12 respectively, and a joint angle θ1 of the boom 11 against a vehicle body (not shown) is detected by the angle detector 15, while a joint angle θ2 of the arm 12 against the boom 11 is detected by the angle detector 16, and the joint angles θ1, θ2 are outputted as angle signals to a valve controller (controller) 20*a*.

A hydraulic cylinder 14 is hydraulically driven by hydraulic oil fed from a main valve 17, and a spool 17A of the main valve 17 is moved by EPC valves (Electrohydraulic Proportional Control valve) 18, 18 forming a pair of proportional electromagnetic valves, thus a flow rate of hydraulic oil to the hydraulic cylinder 14 being controlled.

An actuator 19 according to the present invention is formed with the hydraulic cylinder 14, main valve 17, and EPC valves 18, 18.

A position detector 17B for detecting a position E of the spool 17A is provided on the main valve 17, and data for the position E of the spool is outputted as a position signal to the valve controller 20*a*.

The lever 2 has an inclination angle detector such as a potentiometer or a torque sensor making use of an electrostatic capacity or a laser, and a lever manipulating signal Fa having the 1 versus 1 correlativity with an inclination angle of the lever 2 is outputted from this inclination angle detector to the valve controller 20*a*.

When the lever 2 is at the neutral position, the outputted lever manipulating signal Fa is "0" (zero), indicating that a speed of the boom 11 is "0" (zero). When the lever 2 is inclined forward, the boom 11 moves down at a speed corresponding to the inclination angle, and when the lever 2 is inclined backward, the boom 11 moves upward at a speed corresponding to the inclination angle. The controls as described above are provided by the valve controller 20*a* described hereinafter.

The valve controller 20*a* has the function to make the boom 11 work according to the lever manipulating signal Fa from the lever 2 and also to suppress vibrations when an operation of the lever 2 is started or stopped. The valve controller 20*a* is formed with a microcomputer or the like, and generally is incorporated as a portion of a governor controller mounted for controlling an engine of the hydraulic shovel 1 or for controlling a hydraulic pump, but in this embodiment the valve controller 20*a* is shown as a single body for convenience of descriptions.

Also a valve controller 20*b* for the bucket 13 to which a manipulating signal Fb is inputted and a valve controller 20*c* for the arm 12 to which a manipulating signal Fc is inputted have the substantially same functions and configurations respectively, but herein description is made with reference to the valve controller 20*a* for the boom 11 as the representative, and descriptions of the valve controllers 20*b*, 20*c* are omitted herefrom.

(2) Structure of the Valve Controller 20*a*

More specifically, the valve controller 20*a* comprises, as shown in FIG. 2, a lever manipulating signal input unit 21 to which a lever manipulating signal Fa from the lever 2 is inputted, a target value correcting unit 22 to which a speed target value (operation target value) V1 from the lever manipulating signal input unit 21 is inputted, an instruction signal output unit 23 to which a corrected speed target value (corrected target value) V2 from the target value correcting unit 22 is inputted, and a storage section 24 comprising a RAM, a ROM, or the like.

(2-1) Structure of the Lever Manipulating Signal Input Unit 21

The lever manipulating signal input unit 21 comprises a speed target value computing unit 25 and a work content determining unit 26 each comprising a computer program (software).

The speed target value computing unit 25 computes the speed target value V1 for the boom 11 based on the lever manipulating signal Fa from the lever 2. This speed target value V1 forms a signal waveform having a form like a trapezoid as shown in FIG. 3A, for instance, when the lever 2 is inclined forward and maintained in the state for a prespecified period of time and then is returned to the neutral position.

Figure 3A:
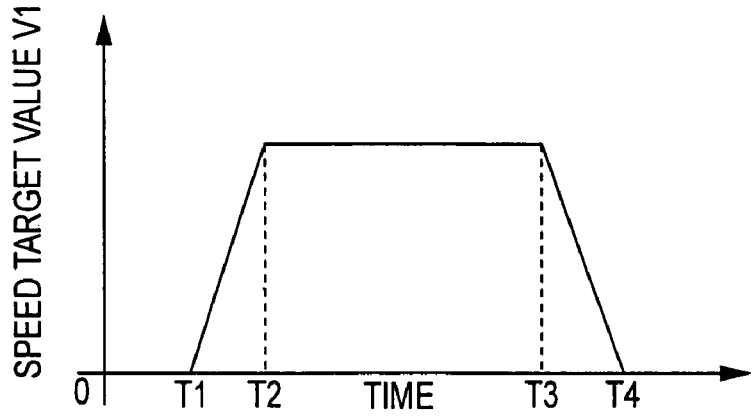
FIG. 3A to FIG. 3C are views for illustrating a speed target value, a speed target value after correction, and a work implement speed.

Namely in FIG. 3A, at the time point T1, the lever 2 is at the neutral position and the boom 11 is in the rest state, and when the lever 2 is inclined forward, the boom 11 moves downward from a high position with acceleration until the time point T2, and if the lever 2 is maintained in the state, the boom 11 moves downward at a constant speed during from the time point T2 to the time point T3, and when the lever 2 is returned to the neutral position, the boom 11 moves downward with deceleration from the time point T3 until the time point T4 and is finally stopped.

The work content determining unit 26 determines a work at a constant speed and a rolling compaction work among works performed with the boom 11, and has the function not to provide controls for suppression of vibrations of the boom 11 during the works specified above. The function is described hereinafter.

(2-2) Configuration of the Target Value Correcting Unit 22

The target value correcting unit 22 has the most characteristic configuration in this embodiment, and comprises a vibration characteristics determining unit 27, a rapid manipulation restricting unit 28, and a vibration suppressing unit 29 each also comprising a computer program (software).

The vibration characteristics determining unit 27 has the function to determine a characteristic frequency ω and a damping coefficient ξ corresponding to postures of the boom 11 and arm 12 in response to input of the joint angles θ1, θ2. The joint angles θ1, θ2 vary within a prespecified range in correlation to changes in postures of the boom 11 and arm 12, but the characteristic frequency ω and the damping coefficient ξ corresponding to the joint angles θ1, θ2 postures of the boom 11 and arm 12 are previously calculated against an actual vehicle and are stored in the storage section 24.

Therefore, when the joint angles θ1, θ2 are inputted, the characteristic frequency ω and the damping coefficient ξ corresponding to the joint angles θ1, θ2 are immediately called out from the storage section 24, and are used by the vibration suppressing unit 29. The parameters ω and ξ for the work implement 10 stored in the storage section 24 are described hereinafter.

The rapid manipulation restricting unit 28 has the function to execute the processing for rapidly starting or stopping an operation of the boom 11 by rapidly manipulating the lever 2, and also this function is described hereinafter.

Figure 3B:
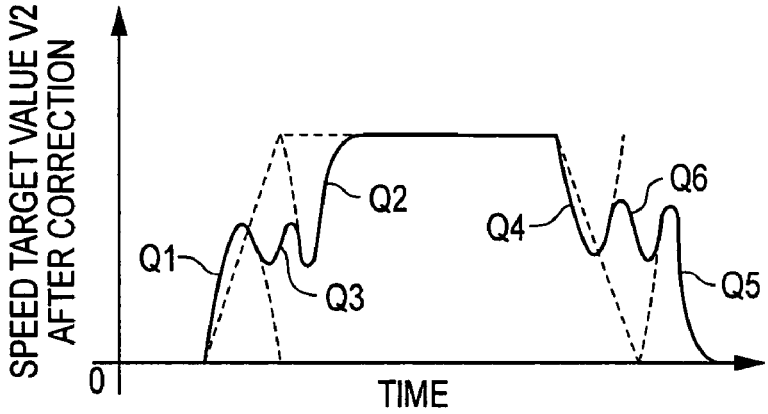

The vibration suppressing unit 29 has the function to correct the speed target value V1 computed from the lever manipulating signal Fa to the speed target value V2 at which vibrations of the boom 11 are suppressed. To describe the correcting operation described above with reference to FIG. 3, a signal waveform for the speed target value V1 as shown in FIG. 3A is corrected to a signal waveform for the speed target value V2 as shown in FIG. 3B.

(2-3) Logic for Correcting the Speed Target Value V2

The specific operations for determining the vibration characteristics and correcting the speed target value V2 are executed according to the following logics.

(a) Principles of Computing for the Speed Target Value V2

Characteristics of the operations of the EPC valve 18 up to those of the work implement 10 complicatedly vary according to a posture of the work implement 10 or a load (pay load) to the work implement 10, but is decided regardless to computing of the valve controller 20*a* in the previous stage.

So in the present embodiment, in order to remove a main component of vibrations of the work implement 10 by means of simple operation, the characteristics from operations of the EPC valve 18 up to those of the work implement 10 are approximated according to the secondary delay characteristics as shown by the equation (1). In the following descriptions, the vibration characteristics of the work implement 10 including the boom 11 are described, but the present invention is not limited to this configuration, and also the vibration characteristics of a vehicle body not show are approximated.

In the following expression, X indicates an input to the EPC valve 18; Y indicates an output from the work implement 10; S indicates a Laplace operator, and ω and ξ are parameters which vary according to a posture or a pay load.

$$\frac{Y}{X} = \frac{\omega^2}{S^2 + 2\zeta\omega S + \omega^2} \tag{1}$$

To cancel the residual vibrations due to the characteristics of operations of the EPC valve 18 to those of the work implement 10, an operator is inserted into a section between an input of the lever 2 to an input of the EPC valve 18 so that an inverse number of the equation (1) is applied to the section before the EPC valve 18. In the present embodiment, for instance, the characteristics as expressed by the following equation (2) are employed.

In the equation (2), U indicates a target value from the lever; X indicates an input to the EPC valve 18; S indicates a Laplace operator; and ω and ξ are the parameters used in the equation (1), and $\omega_0$ is a constant set independently.

$$\frac{X}{U} = \frac{S^2 + 2\zeta\omega S + \omega^2}{\omega^2}\left(\frac{\omega_0}{S + \omega_0}\right)^2 \tag{2}$$

As described above, by employing the configuration in which the characteristics of the EPC valve 18 are canceled by the those before the EPC valve 18, the characteristics of the entire operation sequence from an input of the lever 2 to an operation of the work implement 10 are expressed by a product of the equation (1) by the equation (2), so that vibration of the work implement 10 can be removed as expressed by the equation (3).

In the equation (3), U indicates a target value from the lever 2; X indicates an input to the EPC valve 18; Y indicates an output from the work implement 10; S indicates a Laplace operator, and $\omega_0$ is a constant set independently.

$$\frac{Y}{U} = \frac{X}{U} \times \frac{Y}{X} = \left(\frac{\omega_0}{S+\omega_0}\right)^2 \tag{3}$$

(b) Method for Realizing Computing for Inverse Characteristics

Based on the principles described above, the vibration suppressing unit 29 computes the speed target value as the inverse characteristics as described below.

At first, the equation (2) can be deformed to the equation (4) below. The coefficients C0 to C2, F1, F2 can be correlated to each other as expressed by the equations (5) and (6) below.

In the equations (5) and (6), U indicates a speed target value from the lever 2; X indicates an input to the EPC valve 18; and S indicates a Laplace operator.

$$X = \frac{\omega_0^2}{\omega^2} \times U + \frac{2\omega_0(\zeta\omega - \omega_0)}{\omega^2} \times \left(\frac{\omega_0}{S+\omega_0}\right)U + \frac{\omega^2 + \omega_0^2 - 2\zeta\omega\omega_0}{\omega^2} \times \left(\frac{\omega_0}{S+\omega_0}\right)^2 U = C0 \times U + C1 \times F1 + C2 \times F2 \tag{4}$$

$$C0 = \frac{\omega_0^2}{\omega^2} \quad C1 = \frac{2\omega_0(\zeta\omega - \omega_0)}{\omega^2} \quad C2 = \frac{\omega^2 + \omega_0^2 - 2\zeta\omega\omega_0}{\omega^2} \tag{5}$$

$$F1 = \left(\frac{\omega_0}{S+\omega_0}\right)U \quad F2 = \left(\frac{\omega_0}{S+\omega_0}\right)^2 U = \left(\frac{\omega_0}{S+\omega_0}\right)F1 \tag{6}$$

When the parameters ω and ξ for the work implement 10 are known, by setting $\omega_0$ to an appropriate value, the coefficients C0 to C2 can be regarded as constants.

Therefore by computing the input value U changing from time to time and F1 and F2 derived from U, the input X to the EPC valve 18 can successively be obtained as a linear sum of the values.

The equation for computing F1 from the input U includes a Laplace operator S as expressed by the equation (6), and this is an operational expression for a primary delay filter giving a cutoff frequency $\omega_0$. Therefore, F1 can be computed through the following equation (7) inside the vibration suppressing unit 29 repeating computing at a time interval of Δt.

$$\text{Latest } F1 = \text{Preceding } F1 + (\text{Latest } U - \text{Preceding } F1)/(1+\omega_0 \times \Delta t) \tag{7}$$

From the equation (6), it is understood that the relation between F2 and F1 is the same as that between F1 and U, and therefore F2 can be computed through the following equation (8).

$$\text{Latest } F2 = \text{Preceding } F2 + (\text{Latest } F1 - \text{Preceding } F2)/(1+\omega_0 \times \Delta t) \tag{8}$$

As described above, by computing the coefficients C0 to C2 through the equation (5) and F1 and F2 through the equation (7), (8) and by substituting the computed values into the equation (4), an input X into the EPC valve 18 can be obtained.

When the input X into the EPC valve 18 is obtained, now the vibration suppressing unit 29 can correct the speed target value V1 obtained from the lever manipulating signal Fa from the lever 2 to the speed target value V2 at which the boom 11 does not vibrate.

(c) Method for Estimating the Parameters for the Work Implement 10

When the vibration characteristics of the work implement 10 are approximated with the equation (1), the parameters ω and ξ included in the equation (1) change according to a posture of or a pay load to the work implement 10. These parameters can be measured by actually moving the work implement 10 reciprocally, but as a posture of and a pay load to the work implement 10 change from time to time, it is impossible to measure the parameters each time.

—Estimation Method 1—

As one of the methods for estimating the parameters ω and ξ, it is conceivable previously store values for characteristic frequencies ω and damping coefficients ξ corresponding to joint angles θ1 of the boom 11 and joint angles θ2 of the arm 12 in the storage section 24 and to decide the characteristic frequency ω and damping coefficient ξ according to the actual joint angles θ1 and θ2. As the storage section 24, for instance, that storing therein the characteristic frequencies ω as expressed in Table 1 may be employed, and also for the damping coefficients ξ, the storage section 24 storing therein the data in the similar form can be employed. For instance, based on the method as described above, the vibration characteristics determining unit 27 can determine the vibration characteristics.

TABLE 1

| | θ2 | | | | | | |
|---|---|---|---|---|---|---|---|
| θ1 | 0° | 10° | 20° | 30° | 40° | 50° | 60° |
| 0° | 7 | 7.5 | 8 | 8.5 | 9 | 9.5 | 10 |
| 10° | 7.5 | 8 | 8.5 | 9 | 9.5 | 10 | 10.5 |
| 20° | 8 | 8.5 | 9 | 9.5 | 10 | 10.5 | 11 |
| 30° | 8.5 | 9 | 9.5 | 10 | 10.5 | 11 | 11.5 |
| 40° | 9 | 9.5 | 10 | 10.5 | 11 | 11.5 | 13 |
| 50° | 9.5 | 10 | 10.5 | 11 | 11.5 | 13 | 14.5 |
| 60° | 10 | 10.5 | 11 | 11.5 | 13 | 14.5 | 16 |

—Estimation Method 2—

When it is tried to previously obtain the characteristic frequencies ω and damping coefficients ξ to all of the conceivable postures and pay loads, a long period of time is required for adjustment. Therefore also the method is conceivable in which the parameters ω and ξ for the joint angles θ1 and θ2 are previously decided according to representative postures (at 2 to 4 points) and the parameters ω and ξ for intermediate postures are computed by means of interpolation.

For instance, when representative joint angles θ1 and θ2 are set at three points respectively and optimal values ω are obtained for 3×3=9 postures, 9 types of combinations (θ1, θ2, and ω) are obtained. By solving the determinant (9) as shown below, 9 coefficients A0 to A8 can previously be obtained. HERE $$\begin{bmatrix} 1/\omega 0 \\ 1/\omega 1 \\ 1/\omega 2 \\ 1/\omega 3 \\ 1/\omega 4 \\ 1/\omega 5 \\ 1/\omega 6 \\ 1/\omega 7 \\ 1/\omega 8 \end{bmatrix} = \begin{bmatrix} 1 & \theta 1_0 & \theta 1_0^2 & \theta 2_0 & \theta 1_0 \cdot \theta 2_0 & \theta 1_0^2 \cdot \theta 2_0 & \theta 2_0^2 & \theta 1_0 \cdot \theta_0^2 & \theta 1_0^2 \cdot \theta 2_0^2 \\ 1 & \theta 1_1 & \theta 1_1^2 & \theta 2_1 & \theta 1_1 \cdot \theta 2_1 & \theta 1_1^2 \cdot \theta 2_1 & \theta 2_1^2 & \theta 1_1 \cdot \theta_1^2 & \theta 1_1^2 \cdot \theta 2_1^2 \\ 1 & \theta 1_2 & \theta 1_2^2 & \theta 2_2 & \theta 1_2 \cdot \theta 2_2 & \theta 1_2^2 \cdot \theta 2_2 & \theta 2_2^2 & \theta 1_2 \cdot \theta_2^2 & \theta 1_2^2 \cdot \theta 2_2^2 \\ 1 & \theta 1_3 & \theta 1_3^2 & \theta 2_3 & \theta 1_3 \cdot \theta 2_3 & \theta 1_3^2 \cdot \theta 2_3 & \theta 2_3^2 & \theta 1_3 \cdot \theta_3^2 & \theta 1_3^2 \cdot \theta 2_3^2 \\ 1 & \theta 1_4 & \theta 1_4^2 & \theta 2_4 & \theta 1_4 \cdot \theta 2_4 & \theta 1_4^2 \cdot \theta 2_4 & \theta 2_4^2 & \theta 1_1 \cdot \theta_4^2 & \theta 1_4^2 \cdot \theta 2_4^4 \\ 1 & \theta 1_5 & \theta 1_5^2 & \theta 2_5 & \theta 1_5 \cdot \theta 2_5 & \theta 1_5^2 \cdot \theta 2_5 & \theta 2_5^2 & \theta 1_5 \cdot \theta_5^2 & \theta 1_5^2 \cdot \theta 2_5^2 \\ 1 & \theta 1_6 & \theta 1_6^2 & \theta 2_6 & \theta 1_6 \cdot \theta 2_6 & \theta 1_6^2 \cdot \theta 2_6 & \theta 2_6^2 & \theta 1_1 \cdot \theta_6^2 & \theta 1_6^2 \cdot \theta 2_6^2 \\ 1 & \theta 1_7 & \theta 1_7^2 & \theta 2_7 & \theta 1_7 \cdot \theta 2_7 & \theta 1_1^2 \cdot \theta 2_7 & \theta 2_7^2 & \theta 1_7 \cdot \theta_7^2 & \theta 1_7^2 \cdot \theta 2_7^2 \\ 1 & \theta 1_8 & \theta 1_8^2 & \theta 2_8 & \theta 1_8 \cdot \theta 2_8 & \theta 1_8^2 \cdot \theta 2_8 & \theta 2_8^2 & \theta 1_8 \cdot \theta_8^2 & \theta 1_8^2 \cdot \theta 2_8^2 \end{bmatrix} \begin{bmatrix} A0 \\ A1 \\ A2 \\ A3 \\ A4 \\ A5 \\ A6 \\ A7 \\ A8 \end{bmatrix} \quad (9)$$

During the actual work, the parameter ω is computed with the following equation (10) using the coefficients A0 to A8 described above and the joint angles θ1, θ2 actually measured during the work. More specifically, by previously storing the coefficients A0 to A8 obtained through the equation (9) in the storage section 24, and when the joint angles θ1, θ2 are obtained by means of actual measurement, the vibration characteristics determining unit 27 calls out the stored coefficients A0 to A8 to compute the characteristic frequency ω with the equation (10). Also the damping coefficient ξ can be obtained through the similar operation.

$$\frac{1}{\omega} = (A0 + A1 \cdot \theta 1 + A2 \cdot \theta 1^2) + (A3 + A4 \cdot \theta 1 + A5 \cdot \theta 1^2) \times \theta 2 + (A6 + A7 \cdot \theta 1 + A8 \cdot \theta 1^2) \times \theta 2^2 \quad (10)$$

In the state where the lever 2 is at the neutral position and the boom 11 is not moving as shown in FIG. 3A and FIG. 3B, when the lever 2 is inclined forward to lower the boom 11 with acceleration, the vibration characteristics determining unit 27 computes the characteristic frequency ω and damping coefficient ξ corresponding to a posture of the work implement 10 for a unit period of time Δt by being triggered with the moment (T1) when the lever 2 is moved away from the neutral position from Table 1 or with the equation (10) and also by executing the computing for correction as described above. Using the computed characteristic frequency ω and damping coefficient ξ, the vibration suppressing unit 29 computes C0 to C2, F1, and F2 for each unit period of time Δt through the equations (5), (7), and (8), and also computes the output X with the equation (4) to obtain the corrected speed target value V2 for the unit period of time Δt.

With the operations as described above, the speed target value V1 is corrected to the speed target value V2 comprising, for instance, the curves Q1, Q2, and Q3 as shown in FIG. 3B. In the portion corresponding to the curve Q1, which is formed by being triggered with time T1, the speed target value V2 is corrected so that the speed target value V2 extends outward to become larger as compared to the speed target value V1. In the portion corresponding to the curve Q3, which is the portion after the peak of the curve Q1 to the point corresponding to time T2, the speed target value V2 is corrected to be smaller than the speed target value V1 so as to chase the increase of the speed target value V1. In the portion corresponding to the curve Q2, which is formed by being triggered with time T2 when the speed target value V1 reaches maximum value, the speed target value V2 is corrected so that the speed target value V2 extends outward to become smaller as compared to the speed target value V1, and reaches maximum value at a timing later than time T2 when the speed target value V1 reaches maximum value.

Incidentally, although the whole curve is divided into curve Q1 to Q3 in order to be easily explained, each curve is the result continuously calculated from the equations (5), (7), (8), and (4), therefore there is no need to switch the equations.

On the other hand, when the lever 2 is returned to the neutral position to stop downward movement of the boom 11, the same operation is executed by being triggered with time (T3) when the lever 2 is moved toward the neutral position. For instance, the speed target value V1 is corrected to the speed target value V2 consisting of the curves Q4, Q5, and Q6. In the portion corresponding to the curve Q4, which is formed by being triggered with time T3, the speed target value V2 is corrected so that the speed target value V2 extends outward and becomes smaller as compared to the speed target value V1. In the portion corresponding to the curve Q6, which is the portion after the peak of the curve Q4 to the point corresponding to time T4, the speed target value V2 is corrected to be larger than the speed target value V1 so as to chase the decrease of the speed target value V1. In the portion corresponding to the curve Q6, which is formed by being triggered with time T4 when the speed target value V1 reaches zero, the speed target value V2 is corrected so that the speed target value V2 extends outward to becomes lager as compared to the speed target value V1, and reaches zero at a timing later than time T4 when the speed target value V1 reaches zero, at which the work implement 10 stops.

Figure 3C:
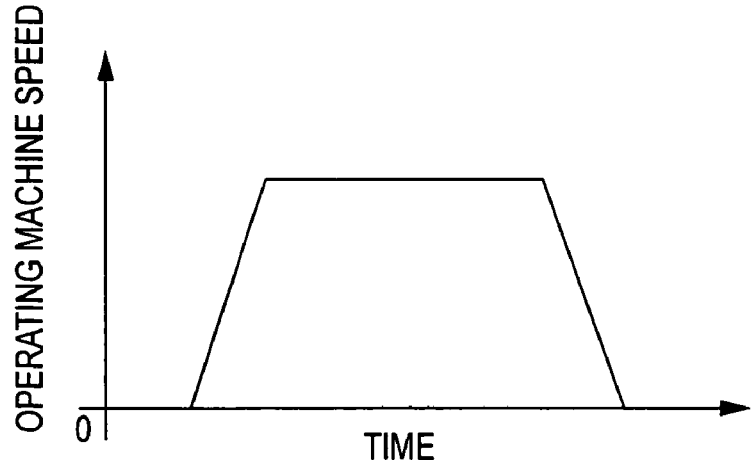

At this time the boom 11 starts its movement according to movement of the actuator 19. In this step, vibrations due to such factors as compression of a hydraulic oil or elasticity of piping are loaded to the section from the actuator 19 to the boom 11, but the vibration components are just inverse to those used in correction of the speed target value V1 to the speed target value V2. Because of this feature, the boom 11 actually moves at the work implement speed shown in FIG. 3C. Namely the signal waveform shown in FIG. 3C is the same as that at the speed target value V1 demanded by the operator, and the boom 11 moves according to the operator's demand without any vibration.

Description of the present embodiment above assumes a case where the speed target value V1 has a signal waveform like a trapezoid, but also when inclining movement of the lever 2 away from the neutral position is once stopped and then the inclination thereof away from the neutral position is restarted during a period of from the time point T1 to the time point T2, or when inclination of the lever 2 toward the neutral position is once stopped and then the inclination in the same direction is restarted during from the time point T3 to the time point T4, namely even when a signal waveform for the target speed value V1 has a substantially convex form, correction of the speed target value V1 is executed in the same way when inclination of the lever 2 is once stopped or restarted. The same is true also for a case when a signal waveform of the speed target value V1 is a step-lie one.

Correction of the speed target value V1 to the speed target value V2 can be made by being triggered with any of the state changing described above, and also a case in which the correction is intentionally made according to the timing delayed from the time point when any of the state changes described above occurs is included in a scope of the present invention.

(2-3) Configuration of the Instruction Signal Output Unit 23

The instruction signal output unit 23 has the function to generate an instruction signal (current signal) G to the actuator 19 based on the corrected speed target value V2 and output the instruction signal G via the amplifier 20A, 20A to the EPC valve 18. The EPC valve 18 moves the spool 17A constituting the main valve 17 based on this instruction signal G, and adjusts a feed rate of hydraulic oil to the hydraulic cylinder 14.

(3) Actions of the Valve Controller 20*a* and Structures of the Work Content Determining Unit 26 and Rapid Manipulation Restricting Unit 28.

Next a method for controlling the boom 11 is described also with reference to the flow chart in FIG. 4, and also the work content determining unit 26 and rapid manipulation restricting unit 28 are described in detail with reference to FIG. 5A, FIG. 5B through FIG. 7.

(a) Step S1: At first, when an operator starts manipulation of the lever 2, the speed target value computing unit 25 in the lever manipulating signal input unit 21 computes the speed target value V1 based on the lever manipulating signal Fa from the lever 2.

(b) Step 2: Then, the work content determining unit 26 is actuated and determines whether the operator manipulate the boom 11 at a constant speed or not.

For making the boom 11 move at a constant speed, it is required to secure an inclined posture of the lever 2 for a certain period of time, but it is difficult for the operator to preserve the inclined posture of the lever 2 without changing the inclination angle at all. Namely even when the operator considers that he or she manipulates the boom 11 at a constant speed, fine vibrations ignorable in actual works occur in the operator's lever manipulation as shown in FIG. 5A, so that the lever manipulating signal Fa is slightly fluctuating.

Figure 5A:
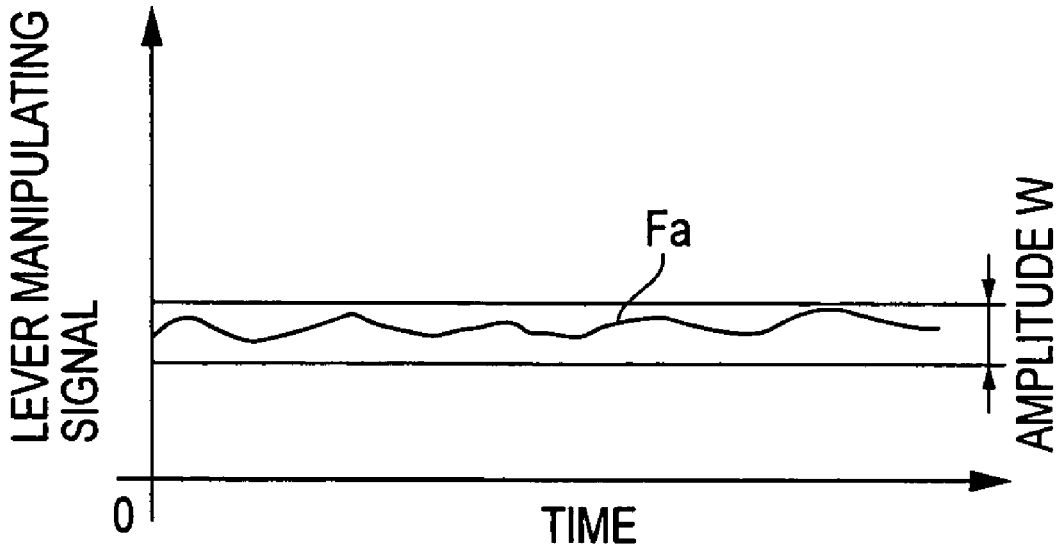
FIG. 5A and FIG. 5B are views each for illustrating a constant speed work.
Figure 5B:
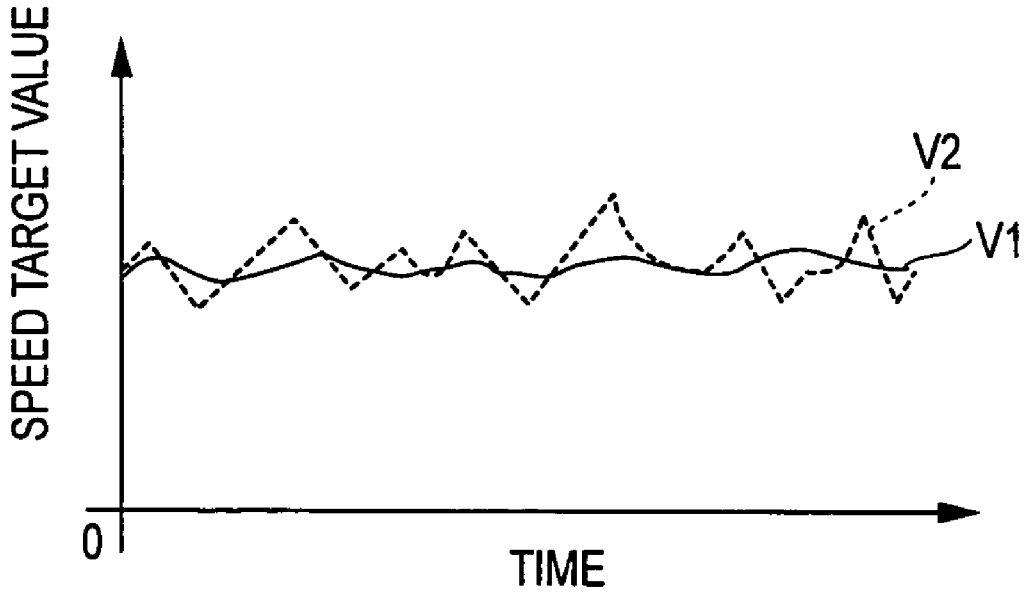

It is allowable to obtain the speed target value V1 based on the lever manipulating signal Fa as described above, but when the speed target value V2 is obtained by correcting the speed target value V1 as described above, fluctuation of the speed target value V2 becomes substantially larger as shown in FIG. 5B. Because of this feature, the boom 11 moving according to the instruction signal G based on the speed target value V2 sensitively reacts to fine fluctuations of the lever 2, which makes it difficult to perform a work at a constant speed.

Further, when width of variation in the speed is small as shown in FIG. 5A, since the vibration of the work implement 10 is small, there is actually no problem even if the correction is not performed by the vibration suppressing unit 29.

To overcome the problem as described above, when fluctuations of the lever manipulating signal Fa is within a prespecified fluctuation width W, the work content determining unit 26 determines that the current work is being carried out at a constant speed and directly generates the instruction signal G based on the speed target value V1. Because of this configuration, in step S2, when the fluctuation of the lever manipulating signal Fa is over a prespecified width W, the work content determining unit 26 determines that the current work is not being performed at a constant speed and enters the step S3, but when the fluctuation of the lever manipulating signal Fa is within the prespecified width W, the work content determining unit 26 determines that the current work is being performed at a constant speed, and skips to the step S8 without carrying out the correction of the speed target value V1 to the speed target value V2.

A constant speed work is often employed when accurate positioning is required by moving the boom 11 at a low speed, and in the case as described above, suppression of sensitive reactions to fine fluctuations of the lever 2 gives many merits.

Step S3: Also in this step, the work content determining unit 26 is actuated and determines whether the operator is carrying out a rolling compaction work or not.

The rolling compaction work is performed by reciprocally moving the lever 2 over the neutral position forward and backward with a short cycle, and in this work vibration generated in the boom 11 is positively utilized. Therefore during the rolling compaction work as described above, if vibrations of the boom 11 are suppressed by correcting the speed target value V1 to the speed target value V2, it is difficult to smoothly carry out the rolling compaction work compared to prior art.

(c) Therefore, in the step S3, when it is determined that the operator is carrying out a rolling compaction work, the work content determining unit 26 skips to step S8 without executing correction of the speed target value V1 to the speed target value V2, and issues an instruction signal G based on the speed target value V1 to drive the actuator 19.

Figure 6:
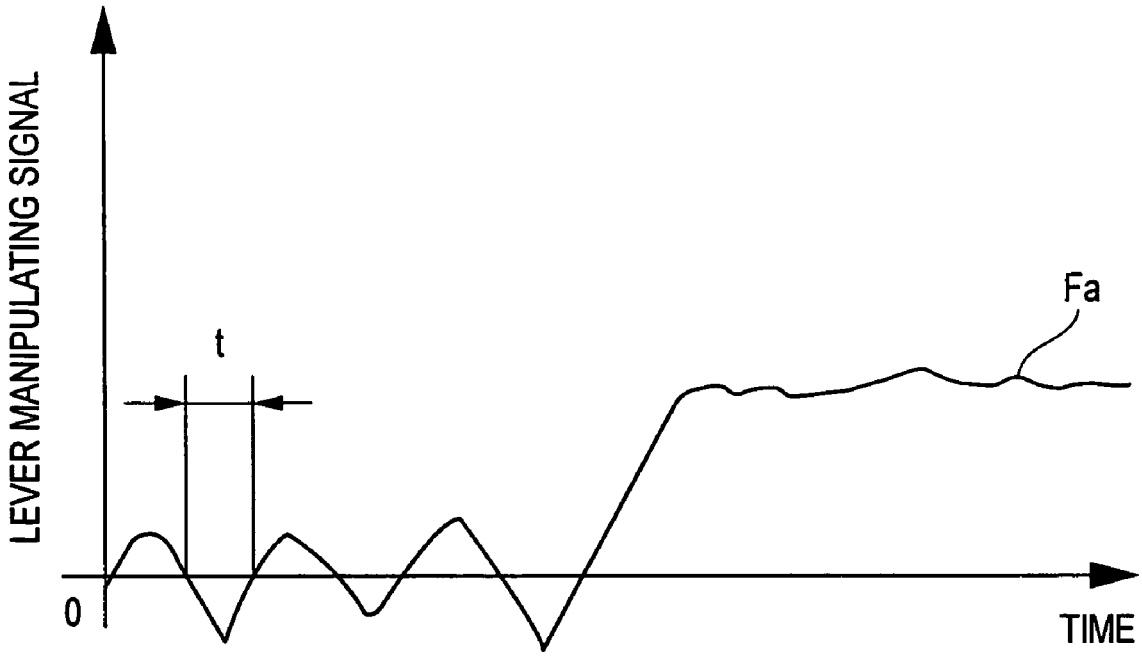
FIG. 6 is a view for a rolling compaction work.

Determination as to whether a rolling compaction work is being carried out or not is performed by detecting a time interval t between time points at which a value of the lever manipulating signal Fa becomes "0" (zero) as shown in FIG. 6. When this time interval t is shorter than a prespecified value, it is determined that a rolling compaction work is being carried out even though the lever 2 is repeatedly operated across the neutral position.

(d) Step S4: When it is determined in step S2 and step S3 that neither a constant speed work nor a rolling compaction work is being carried out, the vibration characteristics determining unit 27 in the target value correcting unit 22 determines the characteristic frequency $\omega$ and damping coefficient $\xi$ corresponding to the joint angles $\theta 1$ and $\theta 2$.

Figure 7:
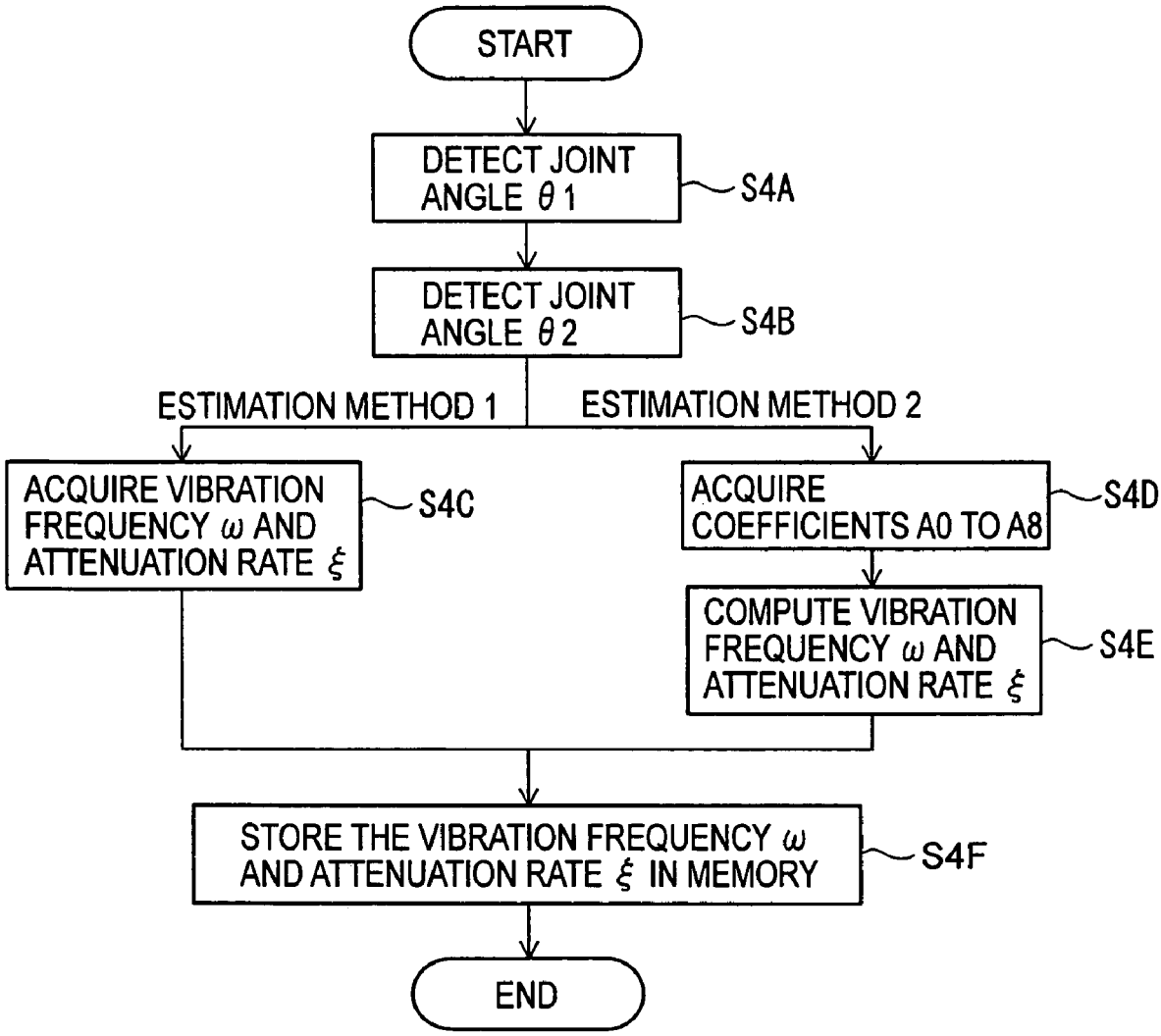
FIG. 7 is a flow chart for illustrating a method for determining the vibration characteristics.

Determination of the characteristic frequency $\omega$ and damping coefficient $\xi$ is carried out based on the method for estimating parameters for the work implement 10 described in (2-3) (c), but more specifically the operation is executed according to the flow chart shown in FIG. 7.

Steps S4A, 4B: The vibration characteristics determining unit 27 acquires the joint angle $\theta 1$ of the boom 11 detected by the angle detector 15 and the joint angle $\theta 2$ of the arm 12 detected by the angle detector 16.

Step S4C: In the estimation method 1, characteristic frequencies $\omega$ corresponding to the joint angles $\theta 1$ and $\theta 2$ are from the table recording therein characteristic frequencies corresponding the joint angles shown in table 1 stored in the storage section 24, and also likely the damping coefficients $\xi$ corresponding to the joint angles $\theta 1$ and $\theta 2$ are acquired from the table recording therein the damping coefficients $\xi$ corresponding to joint angles respectively stored in the storage section 24.

Steps S4D, S4E: In the estimation method 2, the coefficients A0 to A8 stored in the storage section 24 are read out (S4D), and the characteristic frequency ω and damping coefficient ξ are computed through the equation (10) using the coefficients A0 to A8 (S4E).

Step S4F: The characteristic frequency ω and damping coefficient ξ obtained in Step S4D or S4E are stored in a storage such as an RMA provided in the controller 20*a*.

(e) Steps S5, S6: Then, the rapid manipulation restricting unit 28 is actuated and determines based on a speed change rate (slope of a speed change) at the speed target value V1 whether manipulation of the lever 2 is for a rapid manipulation or not.

Figure 8A:
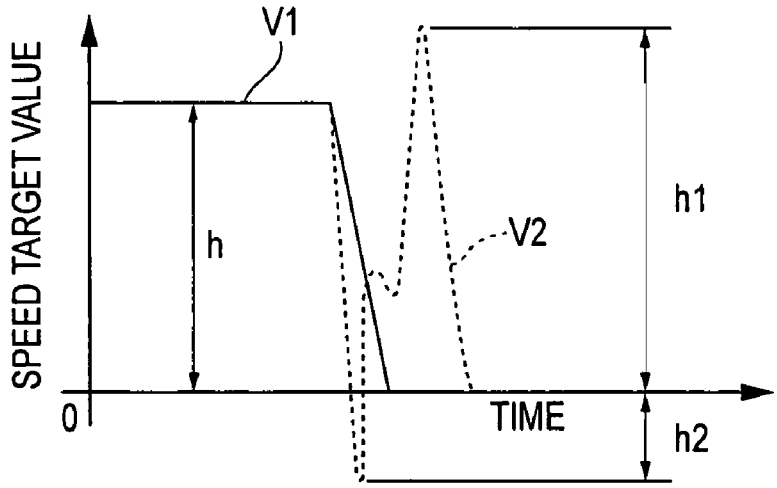
FIG. 8A to FIG. 8C are views each for illustrating a control over rapid manipulation.

For instance, when the boom 11 driven at a certain speed is rapidly stopped as indicated by the speed target value V1 shown in FIG. 8A, for canceling the vibrations which would be generated due to the rapid manipulation unless the rapid manipulation restriction processing is carried out, the correction to the speed target value V2 indicated by the dotted line in the figure is executed in the next step S7. With the speed target value V2, however, sometimes a speed surpassing the maximum speed at which the boom 11 is driven (Refer to h1), or a negative speed is indicated (Refer to h2). The speed target value V2 is mathematically correct, but there is a limit in the speed which the actuator 19 can achieve, and also transitionally instructing a negative speed is difficult because of the structure, so that it is difficult to make the actuator 19 operate according to the speed target value V2 as described above.

Figure 8B:
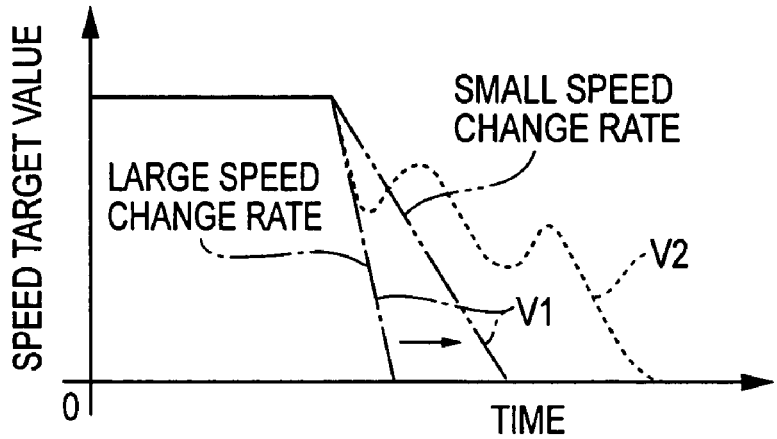

To overcome the problems as described above, the operating state of the lever 2 is constantly monitored by the rapid manipulation restricting unit 28 to check a change rate in the speed, and when it is determined that a change rate in the speed is over a prespecified value due to a rapid manipulation of the lever 2, as shown in FIG. 8B, a slope in the speed change at the speed target value V1 is automatically changed from that indicated by the dashed line to the chain double-dashed line in the figure. Because of this feature, the speed change rate is made smaller on the software to make up a waveform of the speed target value V2 (refer to the dotted line in the figure) for the speed in step S7. Therefore, even if a rapid manipulation of the lever 2 is performed, the speed target value V2 is set within a realizable range, so that the doom 11 can be driven smoothly.

The prespecified value for the speed change rate can be computed based on the parameters ω, ξ, and h obtained in step S4.

Figure 8C:
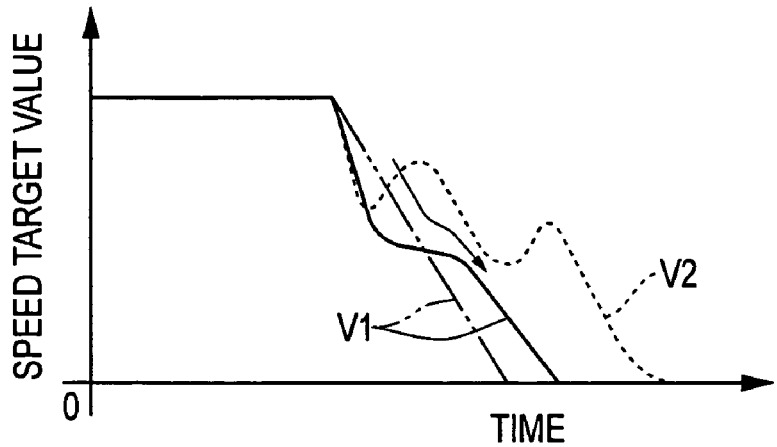

Further, as the rapid manipulation restricting unit 28 is always monitoring the manipulating state of the lever 2, when the lever 2 is transitionally and rapidly returned to the neutral position and then is completely returned to the neural position at an ordinary speed, as shown in FIG. 8C, the rapid manipulation restricting unit 28 instructs the vibration suppressing unit 29 to execute correction to the speed target value V2 based on the speed target value V1 having a small change rate (indicated by the chain double-dashed line) only at a time point when the rapid manipulation is performed, and from the point where the slope becomes milder, the rapid manipulation restricting unit 28 instructs the vibration suppressing unit 29 to execute correction to the speed target value V2 based on the actual speed target value V1 indicated by the solid line in the figure.

Further the rapid manipulation restricting unit 28 as described above is actuated not only when the boom 11 is to be stopped due to a rapid manipulation of the lever 2, but also when an operation of the lever 2 is started with a rapid manipulation.

(f) Step S7: In this step, the speed target value V2 is computed by the vibration suppressing unit 29 from the speed target value V1. When processing for a rapid manipulation is not executed, the speed target value V2 is obtained from the speed target value V1 computed in step S1, and when the processing for a rapid manipulation is executed, the speed target value V2 is computed from the speed target value V1 set by the rapid manipulation restricting unit 28.

Figure 9:
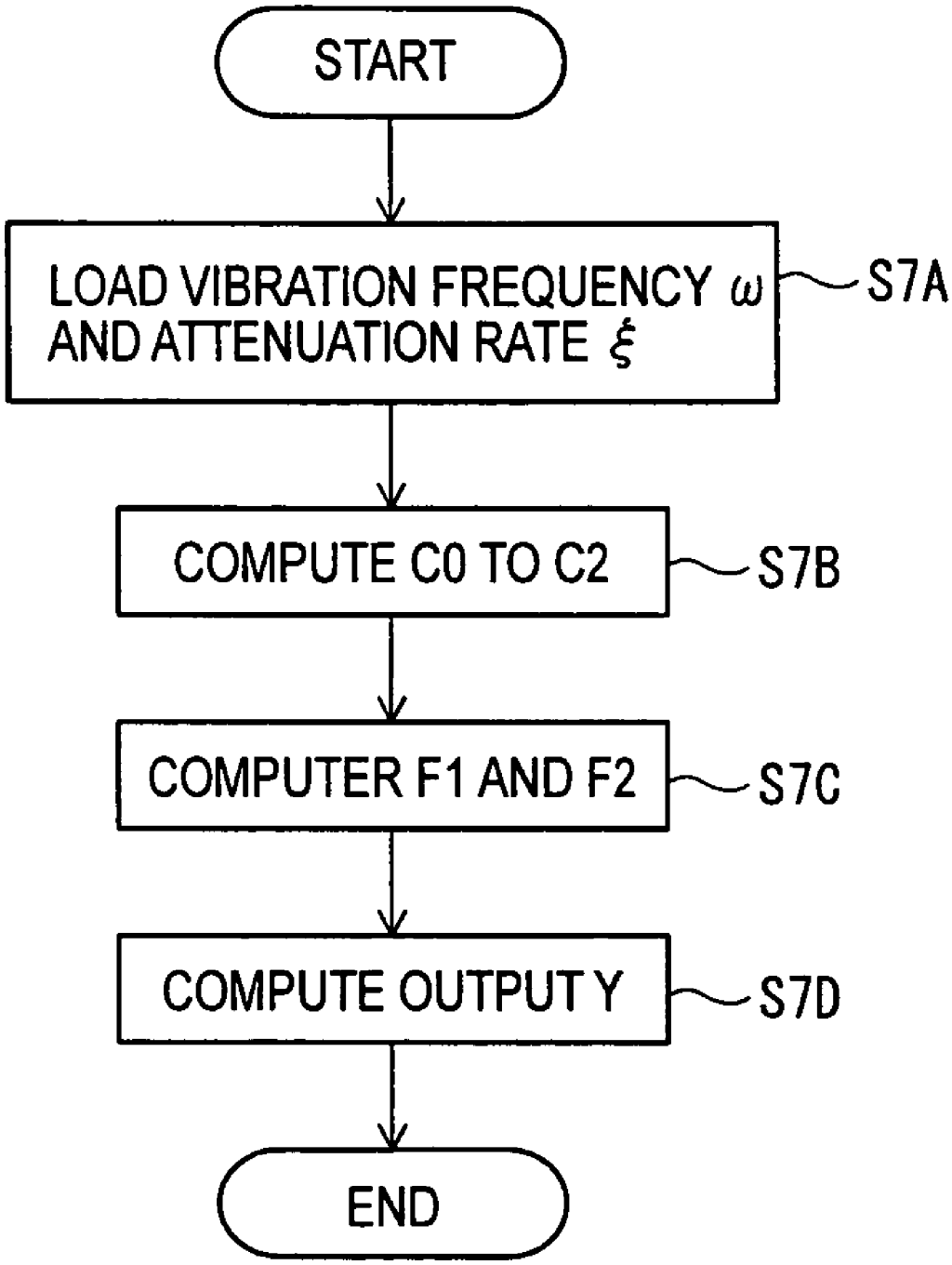
FIG. 9 is a flow chart for illustrating a method for computing for correction of a target value.

In this computing step, the speed target value V2 is computed using the characteristic frequency ω and damping coefficient ξ computed in the step S4 through the equations (5), (7), (8) and (4) according to the operation sequence as shown by the flow chart in FIG. 9.

Step S7A: The vibration suppressing unit 29 loads the values of the characteristic frequency ω and damping coefficient ξ computed in step S4 and stored in a storage such as a RAM.

Step S7B: The coefficients C0 to C2 are computed from the loaded characteristic frequency ω and damping coefficient ξ through the equation (5).

Step S7C: The vibration suppressing unit 29 substitutes the speed target value V1 for the input value U in the equations (7) and (8) and computes F1 and F2 based through the equations (7) and (8).

Step S7D: The computed C0 to C2, F1 and F2 are substituted into the equation (4) to compute the output Y, and this output Y is used as the corrected speed target value V2.

(g) Step S8: Then the instruction signal output unit 23 is actuated, converts the corrected speed target value V2 to an instruction signal G, and outputs the instruction signal G to the EPC valve 18.

(h) Step 9: When the spool 17A of the main valve 17 is moved due to a pilot pressure from the EPC valve 18, the instruction signal output unit 23 monitors a position E of the spool 17A fed back from the position detector 17B, and outputs the instruction signal G so that the spool 17A maintains the correct position.

With the operations as described above, the boom 11 is driven due to a hydraulic pressure from the main valve 17, and in the moment when an operation of the boom 11 is started or an operation of the boom 11 at a certain speed is stopped, this main valve 17 operates based on the speed target value V2, so that vibration of the boom 11 are canceled by the vibration characteristics of the boom 11 itself, so that the boom 11 moves according to the speed target value V1. Namely not to speak of vibrations of the boom 11, also vibrations of a vehicle body of the hydraulic shovel 1 are suppressed.

(4) Advantages Provided by the Embodiment

With the embodiment as described above, there are provided the advantages as described below.

Namely with the valve controller 20*a* mounted on the hydraulic shovel 1, the target value correcting unit 22 comprises the vibration suppressing unit 29, so that the speed target value V1 obtained from the lever manipulating signal Fa can be corrected to the speed target value V2 having the inverse characteristics capable of cancel the vibrations estimated to occur in the boom 11. Therefore, when the actuator 19 is driven according to the instruction signal G generated based on this speed target value V2, vibrations of the boom 11 are canceled because of the vibration characteristics of the boom 11 itself, so that the boom 11 can be moved smoothly without any vibration according to the speed target value V1 before correction.

In this step, the speed target value V1 is corrected to cancel the vibrations of the boom 11, and the principles of vibration suppression are completely different from those in the conventional technology in which a vibration is made lower by mitigating the speed change of the boom 11. Because of this feature, different from limiting a flow rate of a hydraulic oil or dulling the speed target value V1 for make vibrations smaller, a delay in stopping or starting an operation of the boom 11 can be prevented, so that the boom 11 can be moved with quick response to instructions.

The speed target value V1 having any signal form can be corrected to the speed target value V2, so that suppression of vibrations of the boom 11 of arbitrary operating state, which can hardly be realized in the conventional technology, can be achieved without fail.

Further the corrected speed target value V2 is converted to the instruction G as it is, and the instruction signal G is outputted to the main valve 17 for driving the hydraulic cylinder 14, so that another auxiliary device for driving the hydraulic cylinder 14 such as a component corresponding to the second flow rate control valve as used in, for example, cited reference 3 is not necessary, which allows simplification of the structure and control.

The vibration model in this embodiment can approximate the vibration characteristics of a vehicle body itself, so that also vibrations of the vehicle body generated due to fluctuations of the boom 11 can be prevented and in addition propagation of the vibrations to the ground can be prevented, and therefore percussive noises generated due to collision to the ground can effectively be reduced, and even at a site of a construction work in a residential area or during night, negative influences to the peripheral environment can be reduced. Further the vibrations of a vehicle body are little propagated to the ground, so that a construction work can efficiently be carried out even on a base or a foundation having the relatively low rigidity or even on the soft ground.

Further vibrations generated immediately after an operation of the boom 11 is started or stopped can be suppressed, and therefore a period of time required to shift to the next operation can be shortened, which ensures improvement in the work efficiency. Because of the features, especially when transfer of earth and sand is performed repeatedly, or when it is required to quickly and accurately raise the bucket 13 to a prespecified position like in a work on a slope, the present invention is effective.

Further in the technology according to this embodiment, as the boom 11 is driven at a higher speed, the more remarkable effects can be obtained. Therefore, even the large size hydraulic shovel 1 based on the conventional technology capable of coping with a high speed operation under a large load (the maximum speed thereof is usually set low to avoid the danger such as overturn or the like) can smoothly be manipulated without any vibration generated even when the maximum speed thereof is set higher than conventional one. It is needless to say that vibrations can sufficiently be suppressed even in the hydraulic shovel 1 having a medium or small size, even an inexperienced operator not having the skill for smooth manipulation and causing heavy vibrations can smoothly manipulate the medium or small size hydraulic shovel 1.

In addition, as the vibration suppressing unit 29 presenting the most representative feature of this embodiment is software, the vibration suppressing unit 29 can easily be incorporated in the valve controller 20*a* for the hydraulic shovel 1 having been installed at a construction site, so that suppression of vibrations can be realized without causing cost increase.

Further as the vibration characteristics of the boom 11 are determined according to the characteristic frequency ω and damping coefficient ξ, so that the vibration model representing the vibration characteristics can be approximated by a linear secondary delay model. Therefore, without necessity to prepare and select many patterns as disclosed in cited reference 3, correction of the speed target value V1 to the speed target value V2 can easily and accurately be carried out with the linear secondary delay mode.

The characteristic frequency ω and damping coefficient ξ deciding the vibration characteristics can be varied according to the joint angles θ1, θ2 each indicating a posture and a state of the boom 11, so that it is possible to obtain the appropriate vibration characteristics suited to movement of the boom 11 in the vertical direction, so that the operationality of the boom 11 can further be improved by carrying out precise correction of the speed target value V2.

As the work content determining unit 26 is provided in the lever manipulating signal input unit 21, it is possible to determine a constant speed work or a rolling compaction work using the boom 11. With the work content determining unit 26, when any of the works, the vibration of which need not to be suppressed, is being carried out, correction of the speed target value V1 to the speed target value V2 is not performed, and the instruction signal G is generated directly from the speed target value V1 to intentionally skip the step of suppressing vibrations of the boom 11, and therefore negative effects generated due to suppression of vibrations can be eliminated, so that each work can efficiently be carried out.

Further as the rapid manipulation restricting unit 28 is provided in the target value correcting unit 22, a speed change rate can be mitigated by correcting the speed target value V1 when the lever 2 is manipulated rapidly, and therefore there is no possibility that the speed target value V2 disabling actual operation of the boom 11 is obtained after correction of the speed target value V1, so that the boom 11 can be driven and manipulated accurately, and further damages of the actuator 19 or the like can be prevented.

2. Second Embodiment

A second embodiment of the present invention is described below. In the following descriptions, the same reference numerals are used for the same components and functions already described and description thereof is omitted herefrom or simplified herein.

The first embodiment described above is a case where the present invention is applied to the hydraulic shovel 1, and in this case, the joint angles θ1 and θ2 of the boom 11 and arm 12 are detected, the characteristic frequency ω and damping coefficient ξ, are computed from the detected joint angles θ1 and θ2, and correction of the speed target value V2 is carried out based on the computed characteristic frequency ω and damping coefficient ξ.

Figure 10:
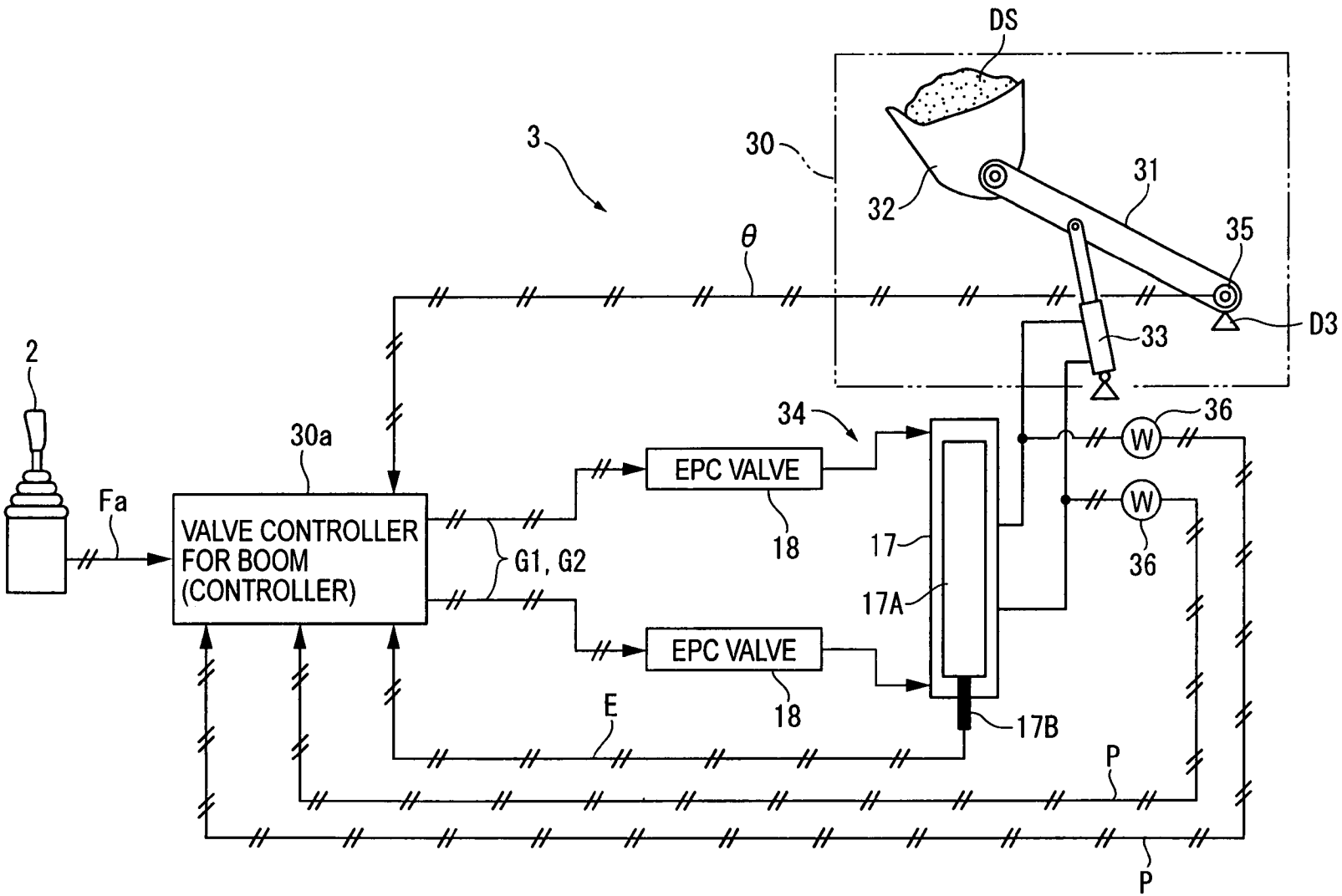
FIG. 10 is a schematic view showing a construction machine with a work implement and a controller each according to a second embodiment of the present invention mounted thereon.

In contrast, in the second embodiment, the present invention is applied to a wheel loader 3 as shown in FIG. 10, and this embodiment is different from the first embodiment described above in the point that an joint angle θ of a boom 31 constituting a work implement 30 of the wheel loader 3 and a hydraulic pressure P of a hydraulic cylinder 33 moving the boom 31 in the vertical direction are detected and correction of the speed target value V2 is carried out based on the detected parameters above.

Figure 4:
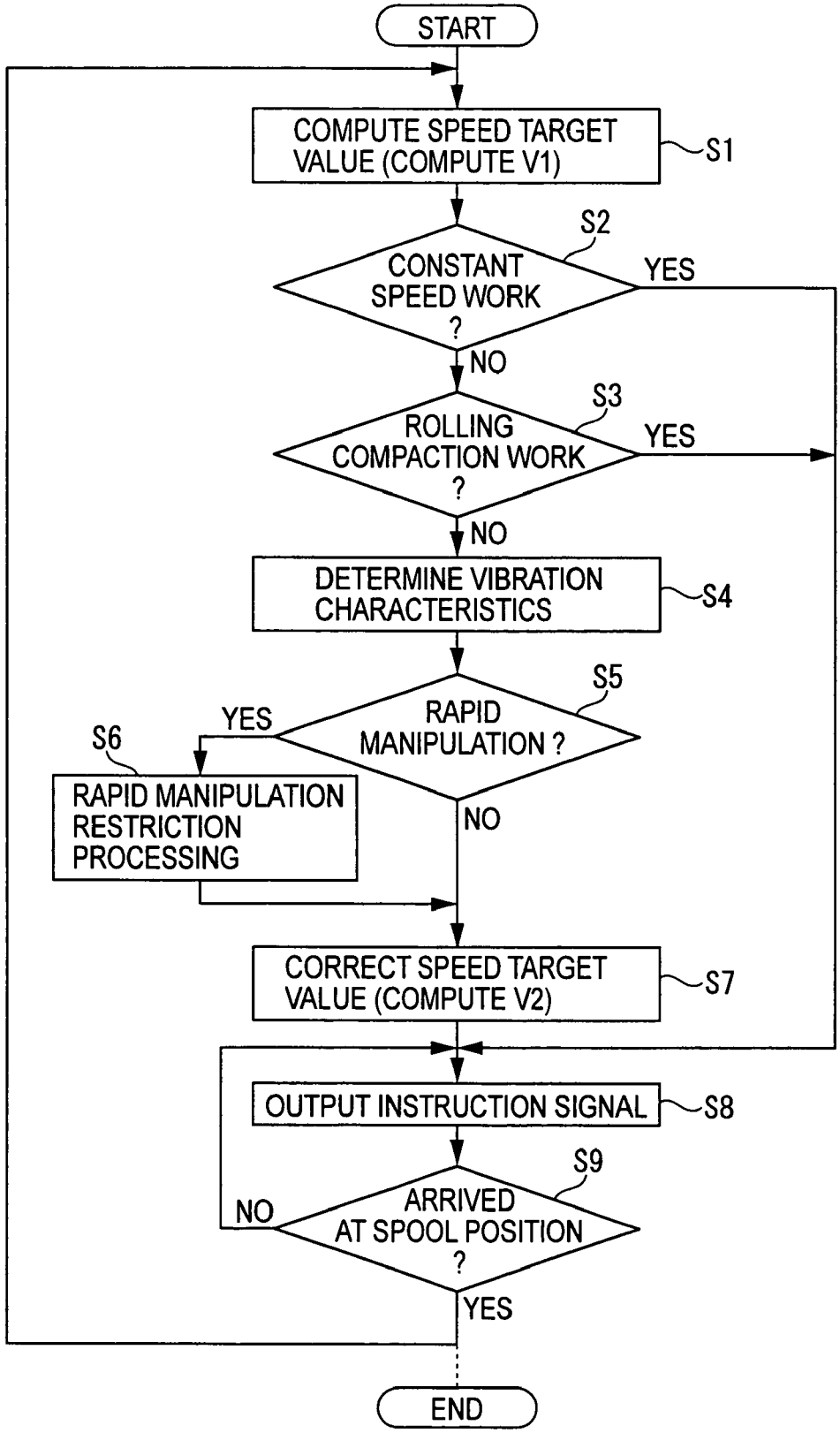
FIG. 4 is a flow chart for illustrating a method for controlling a work implement.

In the first embodiment described above, in the step of controlling the work implement 10 shown in the flow chart in FIG. 4, after a work type is determined by the work content determining unit 26 in step S2, the instruction signal output unit 23 outputs one type of instruction signal G regardless of the determined work type in step S8 to provide controls so that the spool 17A can maintain the accurate position.

Figure 13:
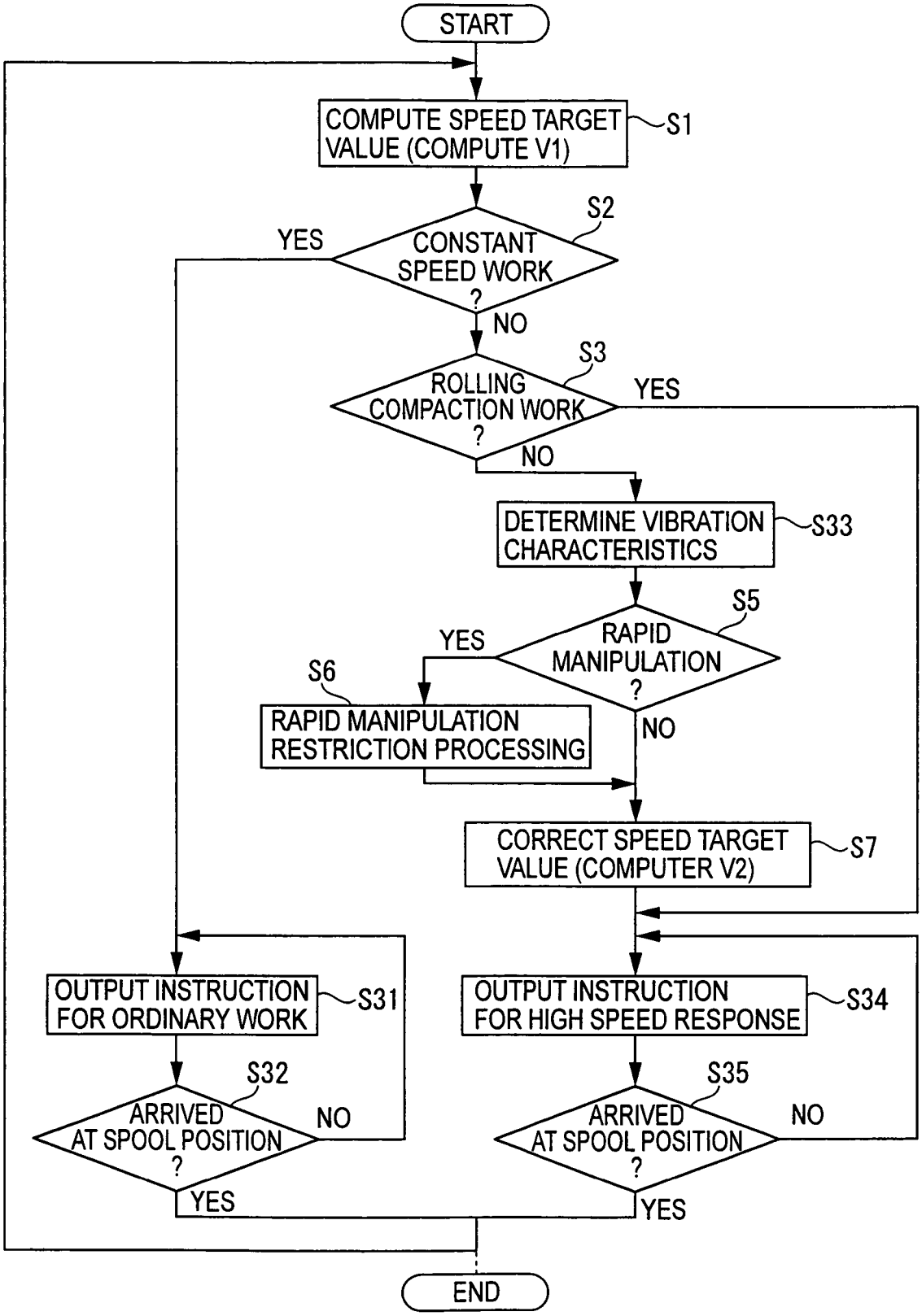
FIG. 13 is a flow chart for illustrating a method for controlling a work implement.

In contrast, the second embodiment, as shown in the flow charts in FIG. 13, is different from the first embodiment in the point that, for controlling the work implement 30, different instruction signals G1, G2 are outputted according to a result of determination of the work type by the work content determining unit 26 to control a position of the spool.

(1) Structure of the Work Implement 30

The wheel loader 3 as a construction machine used in the second embodiment comprises the work implement 30 as shown in FIG. 10, and this work implement 30 comprises a boom 31, a bucket 32, and a hydraulic cylinder 33.

The boom 31 is movably supported at a supporting point D3 on the vehicle body (not shown), and the boom 31 moves up and down in association with extension and compression of the hydraulic cylinder 33.

The bucket 32 is movably attached to a tip of the boom 31 and is rotated in association with extension and contraction of a hydraulic cylinder for the bucket (not shown), for instance, to dump or load the earth and sand DS loaded in the bucket 32.

The work implement 30 as described above comprises, like in the first embodiment, the hydraulic cylinder 33, the main valve 17, and an actuator 34 including the EPC valve 18, and the actuator 34 is driven and controlled according to instructions signals G1, G2 from a controller 30*a*.

An angle detector 35 is provided at the supporting point D3 for the boom 31 to detect a joint angle θ of the boom 31 against the vehicle body, and the detected joint angle θ is inputted as an angle signal to the valve controller 30*a*.

In addition, a pressure sensor 36 is provided in each of a hydraulic oil feed path and a hydraulic oil discharge flow path from the main valve 17 to the hydraulic cylinder 33 in the actuator 34, a pressure signal P is detected by each of the pressure sensors 36, and the detected pressure signal P is outputted as a pressure signal to the valve controller 30*a*.

The pressure signal outputted from the pressure sensor 36 changes according to a pay load when the earth and sand DS or the like is loaded into the bucket 32.

(2) Structure of the Controller 30*a*

Figure 11:
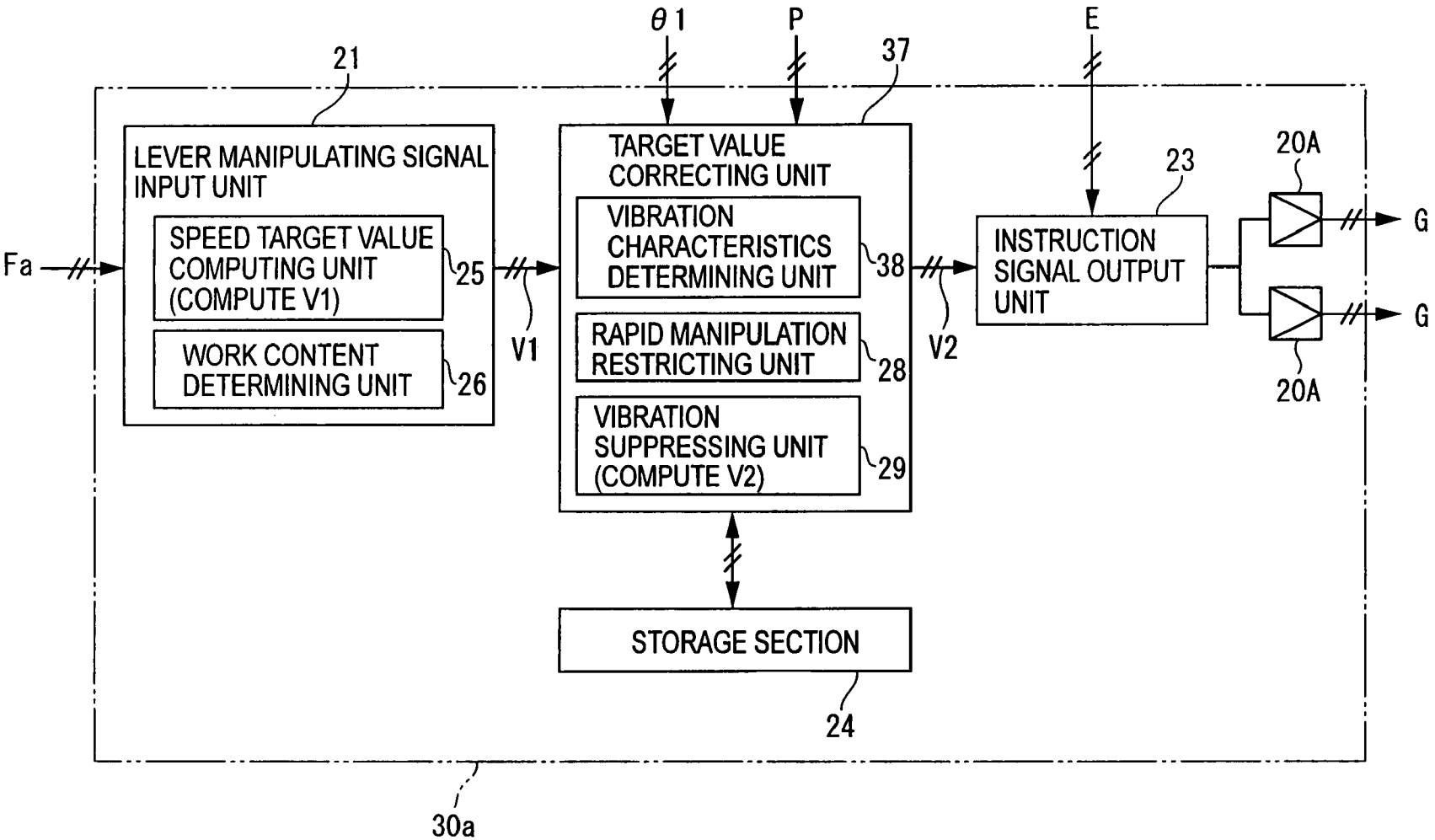
FIG. 11 is a block diagram showing a controller.

The controller 30*a* comprises, as shown in FIG. 11, substantially like the controller 20*a* of the hydraulic shovel 1 according to the first embodiment, a amplifier 20A, a lever manipulating signal input unit 21, an instruction signal output unit 23, and a storage section 24, and is a little different from that in the first embodiment in the processing execute by a target value correcting unit 37.

Namely a target value correcting unit 37 in this embodiment is the same as the first embodiment in that the rapid manipulation restricting unit 28 and vibration suppressing unit 29 execute the same processing as that in the first embodiment, but is different from the corresponding component in the first embodiment in the method for determining the characteristic frequency ω and damping coefficient ξ by the vibration characteristics determining unit 38. Namely in this embodiment, the vibration characteristics determining unit 38 determines the characteristic frequency ω and damping coefficient ξ according to a joint angle θ of the boom 31 as well as to a pressure signal P for the hydraulic pressure feed/discharge flow path from the main valve 17 to the hydraulic cylinder 33.

Figures 12A, 12B:
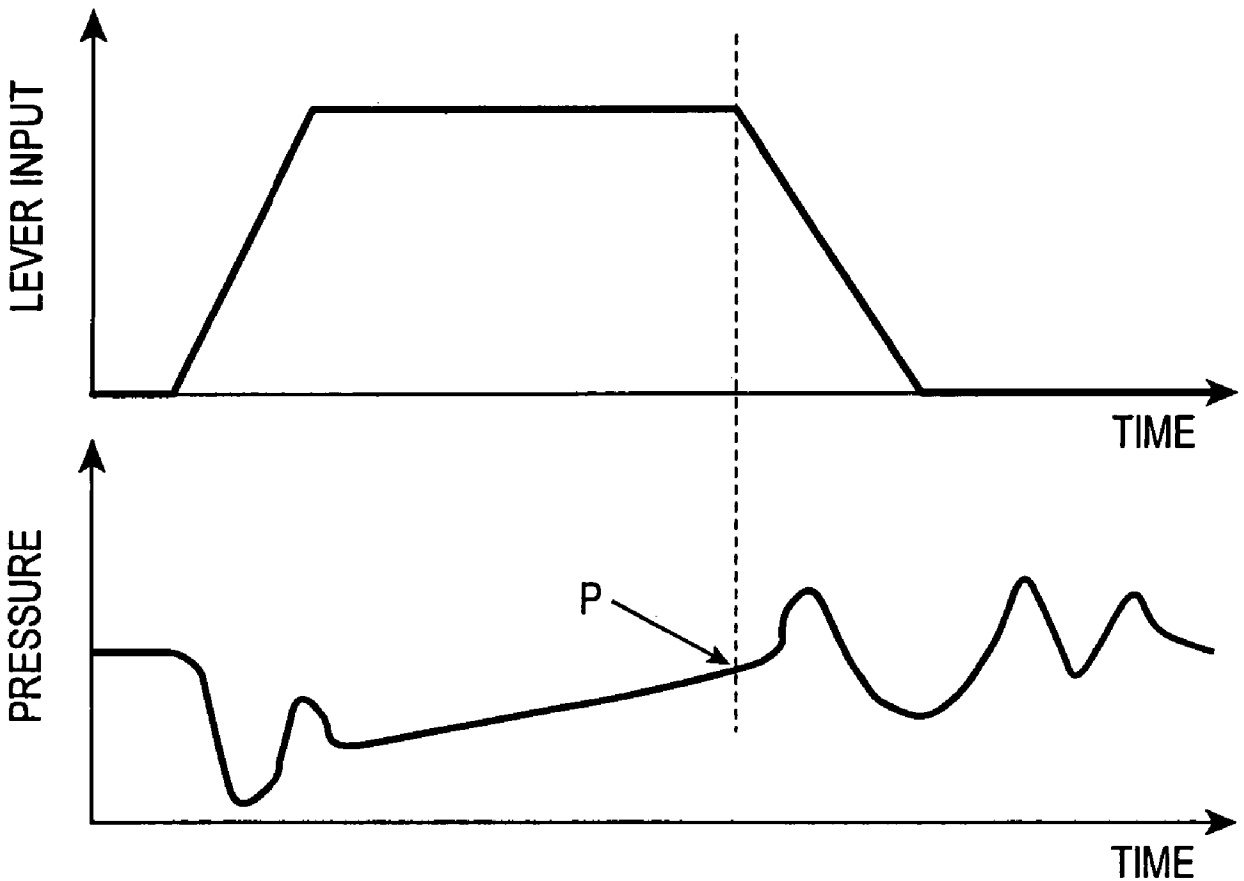
FIG. 12A and FIG. 12B are views each for illustrating a timing for insetting a pressure P.

To remove the pressure variation caused by acceleration/deceleration of the work implement 30, as shown in FIG. 12B, the vibration characteristics determining unit 38 determines the characteristic frequency ω and damping coefficient ξ by acquiring and using a pressure P at a point of time when a constant speed work of the work implement 30 is switched to an operation with deceleration and the joint angle θ at the time point. For determining the characteristic frequency ω and damping coefficient ξ, either one of the estimation method according to the estimation method 1 and the estimation method 2 according to the first embodiment may be employed.

The characteristic frequency ω and damping coefficient ξ determined by the vibration characteristics determining unit 38 are used by the vibration suppressing unit 29 to compute the speed target value V2 according to the same logic as that in the first embodiment.

(3) Functions of the Controller 30*a*

Next, a method for controlling the work implement 30 with the controller 30*a* is described below according to the flow chart shown in FIG. 13 especially centering on portions different from those in the first embodiment.

(a) In each of computing the speed target value V1 with the speed target value computing unit 25 (step S1), determination by the speed target value computing unit 25 as to whether a constant speed work is being carried out or not (step S2), determination by the work content determining unit 26 as to whether a rolling compaction work is being carried out or not (step S3), determination by the rapid manipulation restricting unit 28 as to whether a rapid manipulation is being carried out or not (step S5), processing for restricting a rapid manipulation by the rapid manipulation restricting unit 28 (step S6), and computing for correction of the speed target value V2 by the vibration suppressing unit 29 (step S7), the same processing as that in the first embodiment is carried out respectively.

(b) In the determination in step S2 by the speed target value computing unit 25 as to whether a constant speed work is being carried out or not, when it is determined that a constant speed work is being carried out, the signal instruction output unit S31 outputs an instruction signal G1 for an ordinary work to the EPC valve 18 (step S31), monitors a position E of the spool 17A fed back from the position detector 17B, and outputs the instruction signal G1 so that the spool 17A can maintain the accurate position (step S32).

(c) In step S2 for determining whether a constant speed work is being carried out or not, when it is determined that a constant speed work is not being carried out, and further in the step S3 for determining whether a rolling compaction work is being carried out or not, when it is determined that a rolling compaction work is not being carried out, in the determination of the vibration characteristics by the vibration characteristics determining unit 38 (step S33), as described above the characteristic frequency ω and damping coefficient ξ are determined based on the joint angle θ of the boom 31 and the pressure signal P.

(d) Then after the speed target value V2 is obtained by computing for correction in step S7, the instruction signal output unit 23 is actuated, converts the corrected speed target value V2 to an instruction signal θ2 for high speed response, outputs the signal G2 to the EPC valve 18 (step S34), monitors the position E of the spool 17A fed back from the position detector 17B, and outputs the instruction signal G1 so that the spool 17A maintains the accurate position (step S35).

(4) Advantages Provided by the Embodiment

With the second embodiment as described above, in addition to the advantages provided in the first embodiment, the following advantages are provided.

As the vibration characteristics determining unit 38 determines the vibration characteristics based on the hydraulic pressure P in the hydraulic oil feed path to the hydraulic cylinder 33 as well as to the joint angle θ of the boom 31, even with a construction machine such as the wheel loader 3 having only one joint angle θ, the present invention can be employed and the boom 31 of the wheel loader 3 can be driven quickly and smoothly.

Further the vibration characteristics determining unit 38 determines the vibration characteristics by measuring a pay-load such as earth and sand DS and the like in the bucket 32, and therefore it is possible to make the work implement 30 a suited decelerating operation according to the pay load.

Furthermore, the signal instruction output unit (S31, S34) is switched based on the judgment of whether the operation is the one that needs quick valve response such as a operation with acceleration/deceleration, or a rolling compaction operation, or whether the operation is the one that does not need quick valve response such as an operation at constant speed, therefore the application ranges of the construction machine can be enlarged by properly using a plurality of control laws, for example, when performing a low-speed positioning operation, in which the hunting at the tip of work implement tend to be serious, the valve control insensitive to fine vibration of the lever is used.

3. Third Embodiment

A third embodiment of the present invention is described below.

The joint angle θ of the boom 31 and the hydraulic oil pressure P by the hydraulic cylinder 33 are inputted as signals to the controller 30*a* according to the second embodiment described above, and the vibration characteristics determining unit 38 in the target value correcting unit 37 determines the characteristic frequency ω and damping coefficient ξ based on the joint angle θ and the hydraulic oil pressure P.

Figure 14:
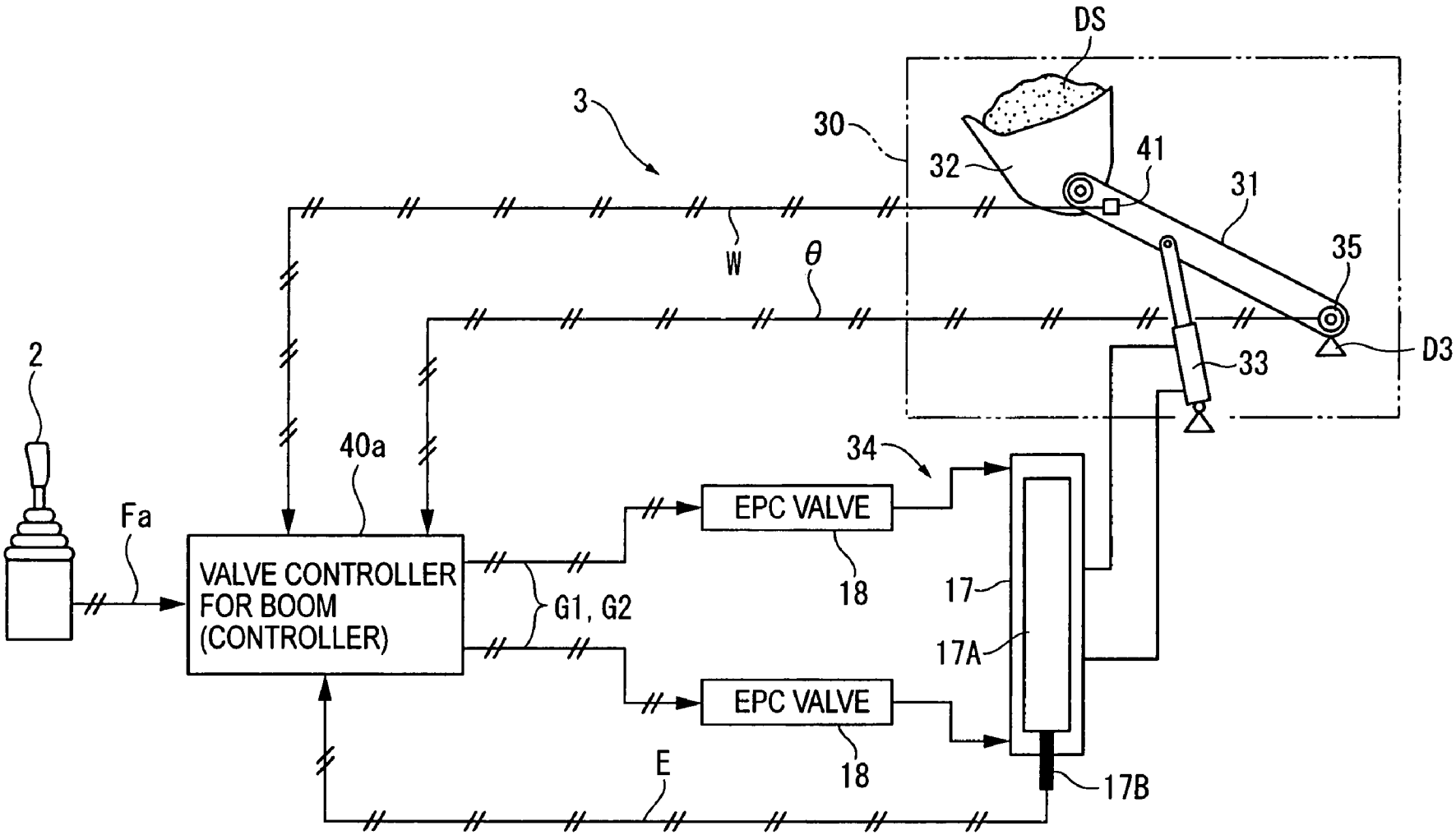
FIG. 14 is a schematic view showing a construction machine with a work implement and a controller each according to a third embodiment of the present invention mounted thereon.

The third embodiment is different from the embodiments described above in that, as shown in FIG. 14, a force sensor 41 such as a distortion gauge is provided near the bucket 32 at a tip of the boom 31 constituting the work implement 30 of the wheel loader 3, and a pay load due to the earth and sand SD or the like in the bucket 32 is detected as a distortion signal W for the boom 31 by the force sensor 41, and the distortion signal is outputted to a controller 40*a*. In the controller 40*a*, the characteristic frequency ω and damping coefficient ξ are determined by the vibration characteristics determining unit based on the joint angle θ from the angle detector 35 and the distortion signal W, but only the input signal W is different, and determination of the characteristic frequency ω and damping coefficient ξ are performed similarly in the second embodiment, so that detailed description thereof is omitted herefrom.

With the third embodiment described above, in addition to the advantages described in the second embodiment, the following advantages are provided.

Namely the vibration characteristics is determined according to the distortion signal W detected by the force sensor 41 provided near the bucket 32, the pay load can be detected more accurately, and it is possible to make the work implement 30 perform an decelerating operation more suited to the actual pay load.

Further, in the second embodiment, since the pressure of the hydraulic cylinder 33, which functions as driver for the work implement 30, is used as signal for detecting pay load, the pressure value includes not only the load and inertia force of the work implement 30 but also the effects of the compressibility of oil and frictional force within the hydraulic cylinder 33, so that it is necessary to acquire the pressure P at the moment when the operation state of the work implement 30 is switched from a constant speed operation to a decelerating operation.

In contrast, since the force sensor 41 of the third embodiment operates on load and inertia force only, the pay load can be detected in the cases of both constant speed operation and accelerating operation, so that the influence of error is reduced and thereby vibration suppressing can be achieved with higher precise.

4. Variants of the Embodiments

The present invention is not limited to the embodiments described above, and other configurations capable of achieving the objects of the present invention and also the following variants are included within a scope of the present invention.

For instance, in the first embodiment, the lever manipulating signal input unit 21 to which the lever manipulating signal Fa is inputted is provided in a main body of the valve controller 20*a* due to restrictions concerning the structure, but the lever manipulating signal input unit 21 may be provided as a functional portion of the valve controller 20*a* in the side of the lever 2, and in this case, the speed target value V1 outputted from the lever manipulating signal input unit 21 is directly inputted to the target value correcting unit 22 within the main body of the valve controller 20*a*.

In the first embodiment, suppression of the vibrations of the boom 11 is described, but the technology may be applied for suppression of vibrations of the arm 12, and if there are other movable portions each causing vibrations, the technology can be applied to the portions.

Further vibrations of the entire construction machine are suppressed in response to the vibration characteristics of the vehicle body, so that the present invention can be carried out regardless of the vibration characteristics of the work implement. In brief, any application for suppressing fluctuations and vibrations according to the vibration characteristics of a construction machine such as a work implement and/or a vehicle body is included within a scope of the present invention.

For example, in the case where the center of gravity of vehicle body varies such as a power shovel, the cab of which moves up and down, the signal from the sensor for detecting the height of the cab can be inputted to the vibration characteristics determining unit. Further, in the case where attachment/detachment of a counterweight is performed, the attachment/detachment is detected by the pay load sensor, and the signal thereof can also be inputted to the vibration characteristics determining unit.

In the first embodiment, a linear secondary delay model is employed as a vibration model of the boom 11, but the vibration model is not limited to this one, and any model may be employed on the condition that vibrations of the boom 11 can previously be estimated.

In the first embodiment, a posture of the boom 11 is determined from the joint angles θ1 and θ2, and the characteristic frequency ω and damping coefficient ξ are determined based on the posture of the boom 11, but the configuration is allowable in which the posture is determined according to a hydraulic pressure (load) generated by the hydraulic cylinder 14 and the characteristic frequency ω and damping coefficient ξ are determined based on this hydraulic pressure.

Further, the configuration also can be the one in which the characteristic frequency ω and damping coefficient ξ are set to the constant value independent of the posture of the boom 11 and the load, although the vibration suppressing of the work implement can not be completely executed with such a configuration, since the joint angle sensor and the pressure sensor is unnecessary, the increase in cost can be suppressed to a low level, yet the vibration suppressing performance is improved to a certain degree compared to the conventional art.

The actuator 19 according to the first embodiment comprises the hydraulic cylinder 14 and the main valve 17 for hydraulically driving the hydraulic cylinder 14, but an electric motor or a hydraulic motor may be used as the actuator according to the present invention for driving the boom 11.

Figure 15:
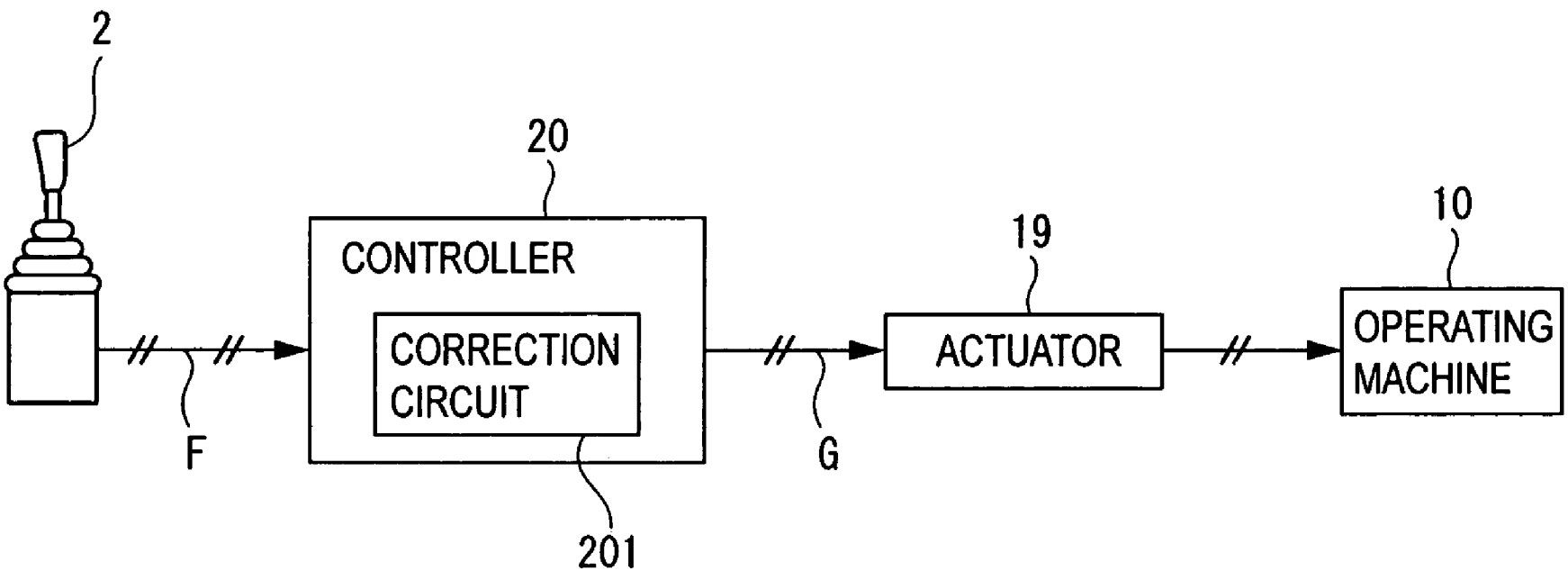
FIG. 15 is a view for illustrating a variant of the present invention.

In the first embodiment, the valve controller 20*a* is used as a controller, and the speed target value computing unit 25 for converting the lever manipulating signal Fa to the speed target value V1 or the vibration suppressing unit 29 for correcting the speed target value V1 to another speed target value V2 is provided in the valve controller 20*a*, but also the configuration not including the units 25, which generates the speed target value V1, is allowable in which a correction circuit 201 is provided as shown in FIG. 15 and an instruction signal G is outputted by directly correcting a lever manipulating signal F. In such a case, the vibration suppressing unit 29 and the instruction signal output unit 23 are replaced as a portion of the function of the correction circuit 201 in the form of assuming the input is F and the output is G. Namely, the correction circuit 201 corrects the lever manipulating signal F so that generation of vibrations in the hydraulic shovel 1 is suppressed in response to the vibration characteristics of the vehicle body and/or the work implement 10 in the hydraulic shovels and outputs the instruction signal G.

Figure 16A:
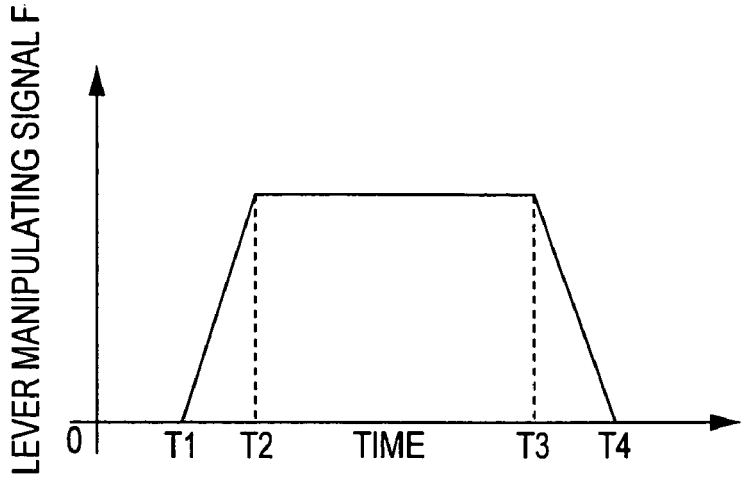
FIG. 16A to FIG. 16C are views for illustrating a lever manipulating signal, a change rate, and an instruction signal respectively.
Figure 16B:
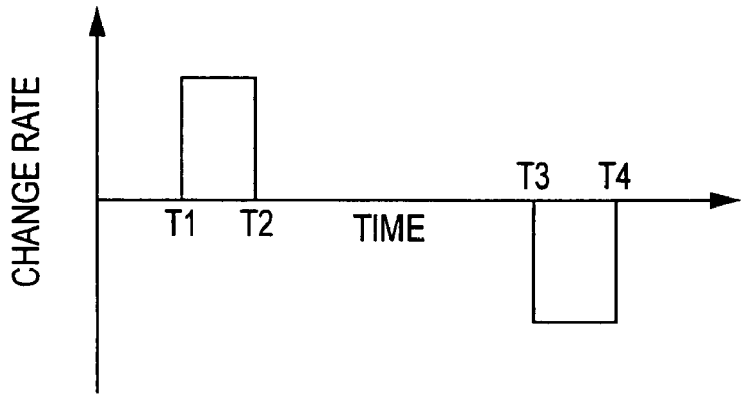
Figure 16C:
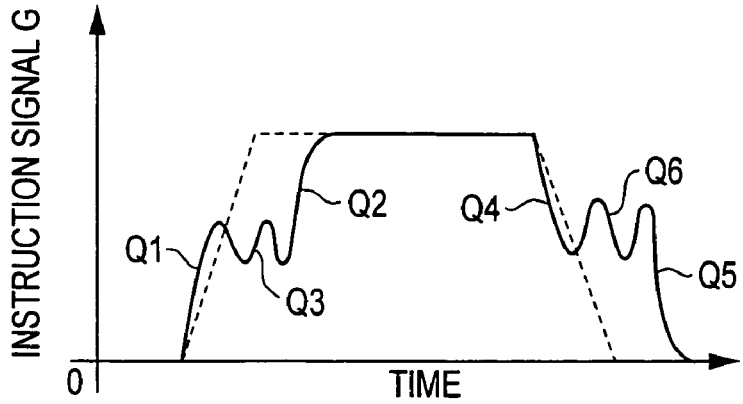

In the case of the configuration as shown in FIG. 15, it is possible to correct the lever manipulating signal F according to the change rate. For instance, a case where the lever manipulating signal F has a trapezoidal waveform is shown in each of FIG. 16A to FIG. 16C. In this operation for correction, the curves Q1, Q5 corresponding to the instruction signal G are formed by being triggered with the moment when a change rate of the lever manipulating signal F start increasing (T1, T4) and also by correcting the lever manipulating signal F to a larger value, and also the curves Q2, Q4 are formed by being triggered with the moment when the change rate of the lever manipulating signal F starts decreasing (T2, T3), and also by correcting the lever manipulating signal F to a smaller value.

However, the correction performed by being triggered with the moment when the change rate starts increasing or decreasing is also possible when the speed target value V1 is corrected to the speed target value V2 as described in the embodiments above.

On the contrary, also when the lever manipulating signal F is directly corrected, the lever manipulating signal F may be corrected to a larger value as indicated by the curve Q1 for the instruction signal G by being triggered with the moment when the lever 2 is moved away from the neutral position, and also the lever manipulating signal F may be corrected to a smaller value as indicated by the curve Q2 for the instruction signal G by being triggered with the time point (T2) when movement of the lever 2 away from the neutral position is stopped.

When the lever 2 is returned to the neutral position to stop downward movement of the boom 11, the lever manipulating signal F is corrected to a smaller value as indicated by the curve Q4 for the instruction signal G by being triggered with the time point (T3) when the lever 2 is moved toward the neutral position, and also the lever manipulating signal F may be corrected to a larger value as indicated by the curve Q5 for the instruction G by being triggered with the time point (T4) when movement of the lever 2 toward the neutral position is stopped (or the lever 2 has been returned to the neutral position).

The best configuration and method for carrying out the present invention are described above for the purpose of disclosure, but the present invention is not limited to the embodiments described above. Namely the present invention is illustrated and described above with reference to the specific embodiments, but forms, quantities, and other detailed configurations can be changed without departing from the technological ideas and objects of the present invention.

Therefore, the descriptions above limiting the forms and quantities are given and exemplified only for the purpose of facilitating understanding of the present invention, and are not indented to limit the present invention, so that descriptions not employing a portion or all of the forms and quantities described above are included within a scope of the present invention.

The priority applications Numbers JP2004-034173 and JP2005-025681 upon which this patent application is based is hereby incorporated by reference.

What is claimed is:

1. A controller for a work implement of a construction machine, comprising:

a manipulating signal input unit including a target value computing section for generating an operation target value for the work implement based on a manipulating signal input from a manipulating unit for manipulating the work implement;

a target value correcting unit for correcting the generated operation target value; and an instruction signal output unit for outputting an instruction signal to an actuator for driving the work implement according to the corrected target value, wherein the target value correcting unit comprises a vibration characteristic determining unit that estimates vibration characteristics of the construction machine based on a characteristic frequency and a damping coefficient corresponding to a posture of and a load to the work implement, and a vibration suppressing unit that corrects the operation target value generated by the target value computing section to another target value that has inverse vibration characteristics to the estimated vibration characteristics based on the characteristic frequency and the damping coefficient to thereby suppress vibrations of the construction machine.

2. The controller for a work implement of a construction machine according to claim 1, wherein the target value correcting unit corrects the generated operation target value to a larger target value when an increase in a rate of change of the generated operation target value is detected, and corrects the generated operation target value to a smaller value when a decrease in the rate of change of the generated operation target value is detected.

3. The controller for a work implement of a construction machine according to claim 1, wherein the manipulating unit is a lever for changing an operation signal when inclined from the neutral position, and the target value correcting unit corrects the generated operation target value to a larger value by being triggered with the moment when movement of said lever toward the neutral position thereof is stopped, and corrects the generated operation target value to a smaller value by being triggered with the moment when said lever is moved toward the neutral position thereof.

4. The controller for a work implement of a construction machine according to claim 1, wherein the manipulating unit is a lever for changing an operation signal when inclined from the neutral position, and the target value correcting unit corrects the generated operation target value to a larger value by being triggered with the moment when the lever is moved away from the neutral position thereof, or when movement of said lever toward the neutral position thereof is stopped, and corrects the generated operation target value to a smaller value by being triggered with the moment when movement of said lever away from the neutral position thereof is stopped, or when the lever is moved toward the neutral position thereof.

5. A method for controlling a work implement of a construction machine comprising:

generating operation target value for the work implement based on a manipulating signal input from an manipulating unit for manipulating a work implement;

estimating vibration characteristics of the construction machine based on a characteristic frequency and a damping coefficient corresponding to a posture of and a load to the work implement; and correcting the generated operation target value to another target value that has inverse vibration characteristics to the estimated vibration characteristics based on the characteristic frequency and the damping coefficient to thereby suppress generation of vibrations of the construction machine, each of the steps above being executed by a controller for the work implement.

6. The method for controlling a work implement of a construction machine according to claim 5, wherein, when an increase in a rate of change of the generated operation target value is detected, the generated operation target value is corrected to a larger value, and when a decrease in the rate of change of the generated operation target value is detected, the generated operation target value is corrected to a smaller value.

7. The method for controlling a work implement of a construction machine according to claim 5, wherein the manipulating unit is a lever for changing an operation signal when inclined from the neutral position, and the generated operation target value is corrected to a larger value by being triggered with the moment when movement of the lever toward the neutral position thereof is stopped, and the generated operation target value is corrected to a smaller value by being triggered with the moment when the lever is moved toward the neutral position thereof.

8. The method for controlling a work implement of a construction machine according to claim 5, wherein the manipulating unit is a lever for changing an operation signal when inclined from the neutral position; and the generated operation target value is corrected to a larger value by being triggered with the moment when the lever is moved away from the neutral position thereof, or when movement of said lever toward the neutral position thereof is stopped, and the generated operation target value is corrected to a smaller value by being triggered with the moment when movement of said lever away from the neutral position thereof is stopped, or when the lever is moved toward the neutral position thereof.

9. A recording medium having stored thereon a computer-executable program for controlling a controller of a construction machine, which has a work implement, to execute functions of:

generating an operation target value for the work implement based on a manipulating signal inputted from an manipulating unit for manipulating a work implement;

estimating vibration characteristics of the construction machine based on a characteristic frequency and a damping coefficient corresponding to a posture of and a load to the work implement; and correcting the operation target value to another target value that has inverse vibration characteristics to the estimated vibration characteristics based on the characteristic frequency and the damping coefficient to thereby suppress generation of vibrations of the construction machine, each of the steps above being executed by a controller for the construction machine.

* * * * *